US007904224B2

(12) United States Patent
Kanayama et al.

(10) Patent No.: US 7,904,224 B2
(45) Date of Patent: Mar. 8, 2011

(54) EXCAVATOR CONTROL MODE SWITCHING DEVICE AND EXCAVATOR

(75) Inventors: Noboru Kanayama, Hiratsuka (JP); Koutarou Sasano, Hiratsuka (JP); Koichi Kawamura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 189 days.

(21) Appl. No.: 11/795,636

(22) PCT Filed: Jan. 12, 2006

(86) PCT No.: PCT/JP2006/300246

§ 371 (c)(1),
(2), (4) Date: Jul. 19, 2007

(87) PCT Pub. No.: WO2006/077759

PCT Pub. Date: Jul. 27, 2006

(65) Prior Publication Data

US 2008/0300757 A1 Dec. 4, 2008

(30) Foreign Application Priority Data

Jan. 20, 2005 (JP) ..... 2005-012837

(51) Int. Cl.

| | |
|---|---|
| ***G06F 7/70*** | (2006.01) |
| ***A01B 17/00*** | (2006.01) |
| ***A01B 13/06*** | (2006.01) |
| ***G08B 21/00*** | (2006.01) |
| ***G05B 19/02*** | (2006.01) |
| ***A01D 34/00*** | (2006.01) |

(52) U.S. Cl. ..... 701/50; 172/132; 172/234; 340/684; 37/414; 37/902; 56/16.2

(58) Field of Classification Search ..... 701/50, 701/73, 117; 361/60, 600, 160; 340/286.01, 340/825; 362/802; 172/4.5, 5, 132, 234
See application file for complete search history.

(56) References Cited

U.S. PATENT DOCUMENTS 5,884,479 A * 3/1999 Huh ..... 60/431

(Continued)

FOREIGN PATENT DOCUMENTS

JP 2583148 * 2/1992

(Continued)

OTHER PUBLICATIONS

EP895003(Derwent), Feb. 1999, JPX, Ishii et al.*

(Continued)

*Primary Examiner* — Jack Keith
*Assistant Examiner* — Muhammad Shafi
(74) *Attorney, Agent, or Firm* — Holtz, Holtz, Goodman & Chick, PC

(57) ABSTRACT

A control-mode switching device includes: a plurality of actuators (2, 6, 7) that conduct different movement; driving means (10, 11, 12, 13, 14, 15) that drive the actuators; a plurality of control levers (22*a*-22*c*) that command operation of the driving means; a plurality of limit switches (72*a*-72*e*) that detect arrival of the control levers to the proximity of an end of a control range; a mode judging means (controller 23) that judges whether a priority operation mode is taken or not in accordance with a combination of on/off conditions of the limit switches; and a drive controlling means (controller 23) that, when it is judged by the mode judging means that the priority operation mode is taken, controls the driving means so that an output of selected one or more of the driving means becomes larger than that in a normal mode or the power ratio as compared with the other driving means becomes larger.

12 Claims, 13 Drawing Sheets

U.S. PATENT DOCUMENTS

| | | | | |
|---|---|---|---|---|
| 6,053,066 | A * | 4/2000 | Ishii et al. | 74/473.18 |
| 6,195,610 | B1 * | 2/2001 | Kaneko | 701/200 |
| 6,233,511 | B1 * | 5/2001 | Berger et al. | 701/50 |
| 6,643,577 | B1 * | 11/2003 | Padgett et al. | 701/50 |
| 6,725,142 | B2 * | 4/2004 | Koch | 701/50 |
| 2002/0062583 | A1 * | 5/2002 | Wakitani et al. | 37/246 |

FOREIGN PATENT DOCUMENTS

| | | | |
|---|---|---|---|
| JP | 2583148 | B2 | 11/1996 |
| JP | 2711831 | B2 | 10/1997 |
| JP | 2583148 | * | 12/1997 |
| JP | 2711831 | * | 12/1997 |
| JP | 2001-304001 | A | 10/2001 |
| JP | 2001304001 | * | 10/2001 |

OTHER PUBLICATIONS

Notification Concerning Transmittal of International Preliminary Report on Patentability and Written Opinion, Chapter 1 of the Patent Cooperation Treaty for PCT/JP2006/300246 dated Jul. 24, 2007. 5 sheets.

* cited by examiner

FIG. 5

| | | | | | SINGLE OPERATION | | OPERATION ON PLURAL SHAFTS, KICKDOWN OPERATION ON ONLY ONE SHAFT (SINGLE-SHAFT SPEED/EXCAVATING POWER UP MODE) | | | OPERATION ON PLURAL SHAFTS, KICKDOWN OPERATION ON PLURAL SHAFTS (POWER-UP MODE) | | |
|---|---|---|---|---|---|---|---|---|---|---|---|---|
| | | OPERATION SHAFT | | (I) STANDARD | (II) EXCAVATING FORCE | | (III) SWING | (IV) BOOM | (V) ARM | (VI) SWING + BOOM | (VII) BOOM + ARM | (VIII) SWING + ARM |
| LEVER INPUT | 1 | BOOM-UP Lsw | 72a | OFF | OFF | ON | OFF | ON | OFF | ON | ON | OFF |
| | 2 | SWING Lsw | 72c/72d | OFF | EITHER ONE ON | OFF | ON | OFF | OFF | ON | OFF | ON |
| | 3 | ARM EXCAVATION Lsw | 72e | OFF | | OFF | OFF | OFF | ON | OFF | ON | ON |
| | | | | | | | | | | | | |
| OUTPUT | 1 | MERGE/BRANCH SWITCHING PILOT VALVE | 50 | OFF (MERGE) | ← | ← | ON (BRANCH) | ← | ← | OFF (MERGE) | ← | ← |
| | 2 | SWING-LOAD-SENSING-PRESSURE SWITCHING PILOT VALVE | 52 | ON (CUTOFF) | ← | ← | OFF (LINK) | ON (CUTOFF) | ← | ON (CUTOFF) | ← | ← |
| | 3 | VARIABLE PRESSURE CONTROL PILOT VALVE | 63 | OFF | ← | ON | OFF | ON | OFF | ON | ON | OFF |
| | 4 | ↑ | 61 | OFF | ON | OFF | ON | OFF | ON | ON | ON | ON |
| | 5 | FLOW CONTROL PILOT VALVE | 75b | OFF | ← | ← | ON | OFF | ON | OFF | ← | ← |
| | 6 | ↑ | 75c | OFF | ← | ← | ← | ON OFF | OFF | ← | ← | ← |
| | 7 | ↑ | 75d | OFF | ← | ← | ← | OFF ON | OFF | ← | ← | ← |
| | 8 | ENGINE GOVERNOR | | OFF (100%) | ← | ← | ← | ← | ← | ON (110%) | ← | ← |

RATIO IN PARENTHESIS REPRESENTS MAXIMUM POWER RATIO

FIG. 6

| | CONTROL LEVER SW | BOOM BSW1 | | ARM ASW | | BUCKET BSW2 | | SWING TSW | |
|---|---|---|---|---|---|---|---|---|---|
| | OPERATIONAL DIRECTION | UP | DOWN | EXCAVATE | DUMP | EXCAVATE | DUMP | RIGHT | LEFT |
| 1. | SINGLE OPERATION | | | | | | | | |
| | EXCAVATING POWER UP MODE | ○ | | | | | | | |
| | | | ○ | | | | | | |
| | | | | ○ | | | | | |
| | | | | | ○ | | | | |
| | | | | | | ○ | | | |
| | | | | | | | ○ | | |
| 2. | OPERATION ON PLURAL SHAFTS & SINGLE SW:ON | | | | | | | | |
| | BOOM PRIORITY MODE | ○ | | | | | | | |
| | | | ○ | | | | | | |
| | ARM PRIORITY MODE | | | ○ | | | | | |
| | | | | | ○ | | | | |
| | BUCKET PRIORITY MODE | | | | | ○ | | | |
| | | | | | | | ○ | | |
| | SWING PRIORITY MODE | | | | | | | ○ | |
| | | | | | | | | | ○ |
| 3. | OPERATION ON PLURAL SHAFTS & PLURAL SW:ON | | | | | | | | |
| | POWER-UP MODE | ○ | | ○ | | | | | |
| | | ○ | | | | ○ | | | |
| | | ○ | | | | | | ○ | |
| | | ○ | | | | | | | ○ |
| | | | | ○ | | ○ | | | |
| | | | | ○ | | | | ○ | |
| | | | | ○ | | | | | ○ |

EXCAVATOR CONTROL MODE SWITCHING DEVICE AND EXCAVATOR

This application is a U.S. National Phase Application under 35 USC 371 of International Application PCT/JP2006/300246 filed Jan. 12, 2006.

TECHNICAL FIELD

The present invention relates to a control-mode switching device of a construction machine and a construction machine. More specifically, it relates to a control-mode switching device and a construction machine that are capable of easily switching the operation modes of a construction machine such as an excavator.

BACKGROUND ART

A hydraulic excavator as shown in FIGS. 13A and 13B is known as a construction machine for excavating and loading earth and sand, which includes: a traveling hydraulic motor 1 for traveling a lower traveling body a; a swing hydraulic motor 2 for swinging an upper swing body b; work equipments c (a boom 3, an arm 4 and a bucket 5) mounted on the front side of the upper swing body b; and a boom cylinder 6, arm cylinder 7 and bucket cylinder 8 for driving the work equipments c.

The hydraulic excavator performs a sequence of operations during an excavating process such as excavation, lift-up swing, earth removal and lift-down swing. Especially during the lift-up swing, while the boom is lifted up and the arm is dumped (as shown in FIG. 13A), swing operation is conducted toward a loading platform of a dumper truck d that is stopped around forty-five, ninety or one-hundred-eighty degrees from the excavated point (as shown in FIG. 13B).

When the swing and boom movements or the swing and arm movements are concurrently conducted, pressure in swing circuit is influenced by boom circuit or arm circuit, where, if the boom circuit or the arm circuit is in low pressure, the swing circuit is also in low pressure, so that smooth swing movement may not be conducted.

Further, since the swing angle differs according to the stop position of the dumper truck d, an operator controls spool-opening degree of flow control valve of hydraulic actuators for each operation to control supply flow rate toward respective circuits to match both of the movements. For instance, the supply flow rate to the respective circuits is controlled so that: when the dumper truck d is stopped at forty-five degrees position from the excavated point, the boom-lift movement is accelerated and swing speed is decelerated; and, when the dumper truck d is stopped at one-hundred eighty degrees position from the excavated point, the swing speed is accelerated and boom-lift speed is decelerated, thereby matching both of the movements. However, such operation is very difficult and exhausting.

Accordingly, the Applicant of the present application has proposed a hydraulic control circuit of a hydraulic excavator for resolving the above problems (Patent Document 1).

Specifically, the hydraulic control circuit of a hydraulic excavator includes: hydraulic actuators respectively for boom-lifting, arm-lifting and swinging movement; boom control lever; arm control lever; swing control lever; hydraulic circuit for driving the hydraulic actuators based on the operation on the control levers; and an operation-mode selecting switch. When one of boom-priority mode, swing-priority mode and standard mode is selected by the operation mode selecting switch, pressure oil is preferentially flowed to the hydraulic circuit corresponding to the selected mode.

[Patent Document] Japanese Patent Publication No. 2583148

DISCLOSURE OF THE INVENTION

Problem to be Solved by the Invention

However, in the hydraulic control circuit of hydraulic excavator as described in the above patent document 1, when the boom-priority mode or the swing-priority mode is to be selected while operating the boom control lever, arm control lever and swing control lever, one hand has to be released from the control lever in order to switch the operation mode selecting switch, resulting in troublesome switching operation.

An object of the present invention is to provide a control-mode switching device and a construction machine capable of easily switching operation modes.

Means for Solving the Problems

A control-mode switching device of a construction machine according to an aspect of the present invention includes: a plurality of actuators that conduct different movement; a driving means that respectively drives the plurality of actuators; a plurality of control levers that command movements of the driving means; a plurality of detecting means that respectively detect arrival of the control levers to the proximity of ends of the control ranges of the control levers; a mode judging means that judges whether a priority operation mode in which output of selected one or more of the driving means becomes larger than that in a normal mode or power ratio of the selected one or more of the driving means as compared to other driving means becomes larger is taken or not based on a combination of detected conditions of the detecting means; and a drive controlling means that, when it is judged by the mode judging means that the priority operation mode is taken, controls the driving means so that the output of the selected one or more of the driving means becomes larger than that in the normal mode or the power ratio of the selected one or more of the driving means as compared to other driving means becomes larger.

The output of the driving means is speed, power and the like. Further, that "output of selected one or more of the driving means becomes larger than that in a normal mode" means that the output during the priority operation mode becomes larger than the output during the standard operation mode. That "the power ratio of the selected one or more of the driving means as compared to the other driving means becomes larger" means all of the situations where the power ratio is relatively increased in relation to the output of the other driving means as in a case where the output of the other driving means is lowered without changing the output of the selected one or more of the driving means.

According to the above arrangement, when the control lever is manipulated, the actuator is driven via the driving means. Accordingly, desired operation can be executed by manipulating a plurality of control levers to simultaneously or sequentially drive the plurality of actuators.

During the operation, when it is desired to, for instance, accelerate a certain actuator, the control lever for driving the actuator is manipulated to the proximity of the end of the control range of the lever. Then, the arrival of the control lever to the proximity of the control range is detected by the detecting means. Subsequently, in accordance with the combination of detected conditions of the detecting means, whether the priority operation mode is taken or not is judged. When it is judged that the priority operation mode is taken, the driving means is controlled so that the output of the selected one or more driving means corresponding to the priority operation mode becomes larger than that in the normal mode or the power ratio as compared to the other driving means becomes larger. Accordingly, the movement of the selected actuator(s) can be, for instance, accelerated.

Accordingly, since the operation mode can be switched to the priority operation mode only by manipulating the control lever to the proximity of the end of the control range while manipulating the control lever without releasing the control lever, the switching operation to the priority operation mode can be facilitated.

In the above control-mode switching device of a construction machine, the mode judging means preferably includes: a storing means that stores a plurality of priority operation modes corresponding to the combination of the detected conditions of the detecting means; and a selecting means that selects the priority operation mode corresponding to the combination of the detected conditions of the detecting means from the storing means.

According to the above arrangement, since the plurality of priority modes are stored in the storing means corresponding to the combination of the detected conditions of the detecting means, the priority operation mode set in accordance with the combination of the detected conditions of the detecting means can be easily changed.

In the above control-mode switching device, the actuator is preferably a hydraulic actuator, the driving means preferably includes a hydraulic circuit and a flow-rate controlling means that controls a flow rate of the hydraulic circuit, and, when it is judged by the mode judging means that the priority operation mode is taken, the drive controlling means preferably controls the flow-rate controlling means preferably so that pressure oil supply that is supplied to selected one or more of the hydraulic circuits becomes larger than pressure oil supply that is supplied to the other hydraulic circuit.

According to the above arrangement, since the actuator includes a hydraulic actuator and the respective driving means includes hydraulic circuit, great force can be exerted when applied on a machine that requires considerable power (e.g. excavator) and satisfactory excavating operation can be achieved. Further, since the drive controlling means is configured to control the flow-controlling means so that the pressure oil supply supplied to the hydraulic circuit becomes larger than the pressure oil supply supplied to the other hydraulic circuit, the drive controlling means can be achieved with a relatively simple arrangement.

In the control-mode switching means of construction machine of the present invention, an engine for driving the plurality of driving means is preferably provided and the drive controlling means preferably increases and decreases the power of the engine.

Alternatively, in the control-mode switching device of construction machine of the present invention, a battery for driving the plurality of driving means is preferably provided and the drive controlling means preferably increases and decreases the power of the battery.

According to the above arrangement, since the priority operation mode is conducted by increasing and decreasing the power of the engine for executing the priority operation mode, the entire power can be augmented.

In the above control-mode switching device, the actuator preferably includes a hydraulic actuator, the driving means preferably include a hydraulic circuit and a variable pressure-control valve that controls the pressure in the hydraulic circuit, and, when it is judged by the mode judging means that the priority operation mode is taken, the variable pressure-control valve preferably is controlled so that pressure in the selected one or more of the hydraulic circuits becomes larger.

According to the above arrangement, since the actuator is provided by the hydraulic actuator and the respective driving means is provided by the hydraulic circuit, where the priority operation mode is executed by controlling the variable pressure-control valve provided in the hydraulic circuit, simple arrangement can be achieved.

In the control-mode switching device of a construction machine of the present invention, a notifying means that allows an operator to recognize an arrival of the control lever to the proximity of the control range is preferably provided.

According to the above arrangement, since the notifying means that allows an operator to recognize the arrival of the control lever to the proximity of the control range is provided, an operator can recognize the arrival of the control lever to the proximity of the end of the control range.

A construction machine according to another aspect of the invention includes the above-described control-mode switching device of the present invention.

According to the above arrangement, a construction machine having the function of the above-described control-mode switching device can be provided.

BRIEF DESCRIPTION OF DRAWINGS

FIG. 5 is an illustration showing details of priority operation modes according to the first embodiment;

FIG. 6 is an illustration showing details of priority operation modes according to a modification of the first embodiment;

EXPLANATION OF CODES

2 . . . swing hydraulic motor (hydraulic actuator), 6 . . . boom cylinder (hydraulic actuator), 7 . . . arm cylinder (hydraulic actuator), 10 . . . variable displacement hydraulic pump (a component of driving means and hydraulic circuit), 11 . . . delivery line (a component of driving means and hydraulic circuit), 12 . . . pressure compensated flow-control valve (a component of driving means and hydraulic circuit, flow-rate controlling means), 13 . . . variable displacement hydraulic pump (a component of driving means and hydraulic circuit), 14 . . . delivery line (a component of driving means and hydraulic circuit), 15 . . . pressure compensated flow-control valve (a component of driving means and hydraulic circuit, flow-rate controlling means), 16 . . . pressure compensated flow-control valve (a component of driving means and hydraulic circuit, flow-rate controlling means), 22*a* . . . arm control lever, 22*b* . . . swing control lever, 22*c* . . . boom control lever, 22*d*-22*f* . . . electric control levers, 23 . . . controller, 23A . . . mode judging unit, 23A1 . . . storing means, 23A2 . . . selecting means, 23B . . . drive controlling means, 66,67 . . . variable pressure-control valves, 72*a*,72*c*, 72*d*,72*e* . . . limit switch (detecting means), 80 . . . notifying unit, 91 . . . engine, 110 . . . battery

BEST MODE FOR CARRYING OUT THE INVENTION

An embodiment of the invention will be described below with reference to attached drawings.

First Embodiment

Figure 1:
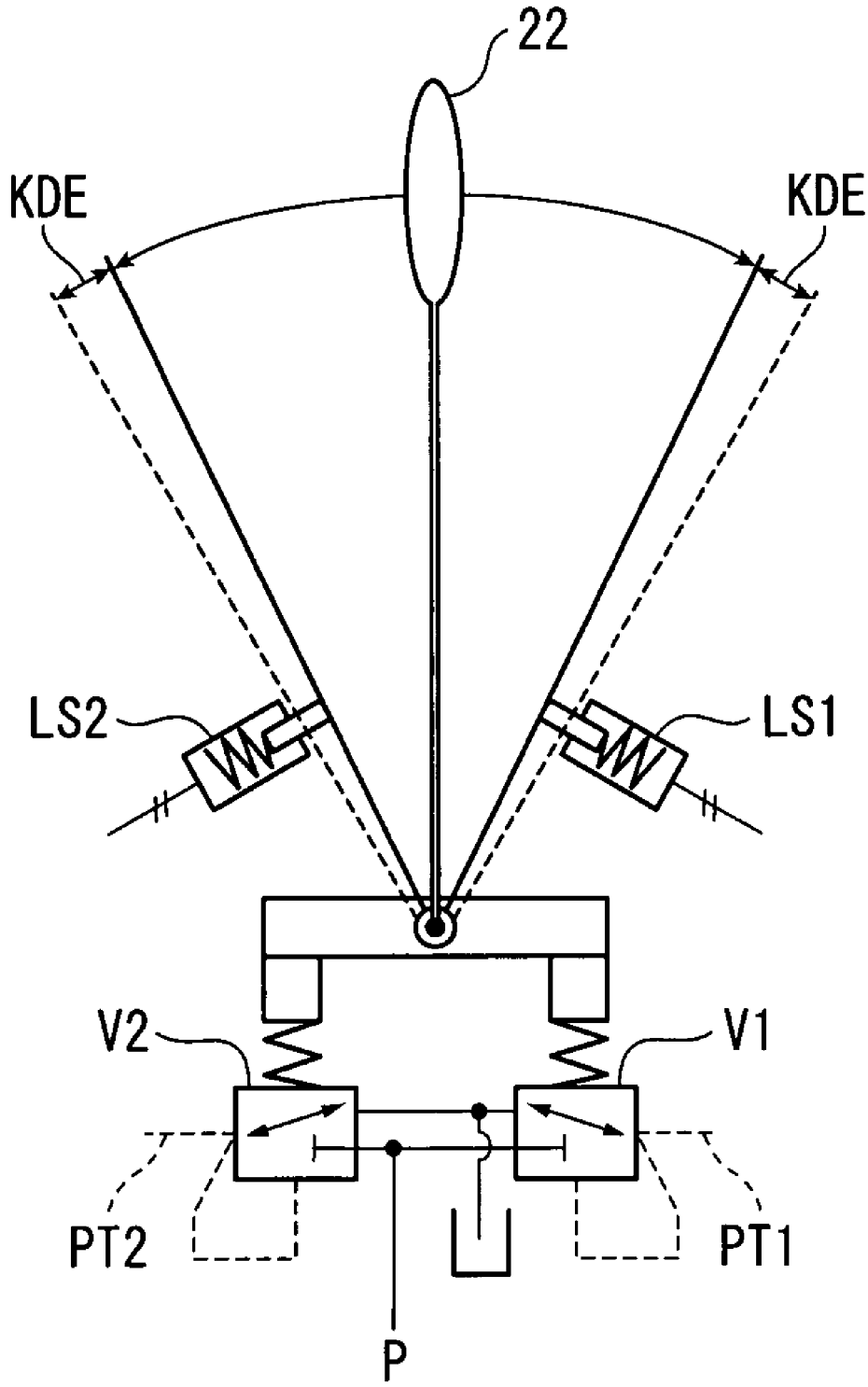
FIG. 1 is a schematic illustration of a control lever according to a first embodiment of the invention.
Figure 2:
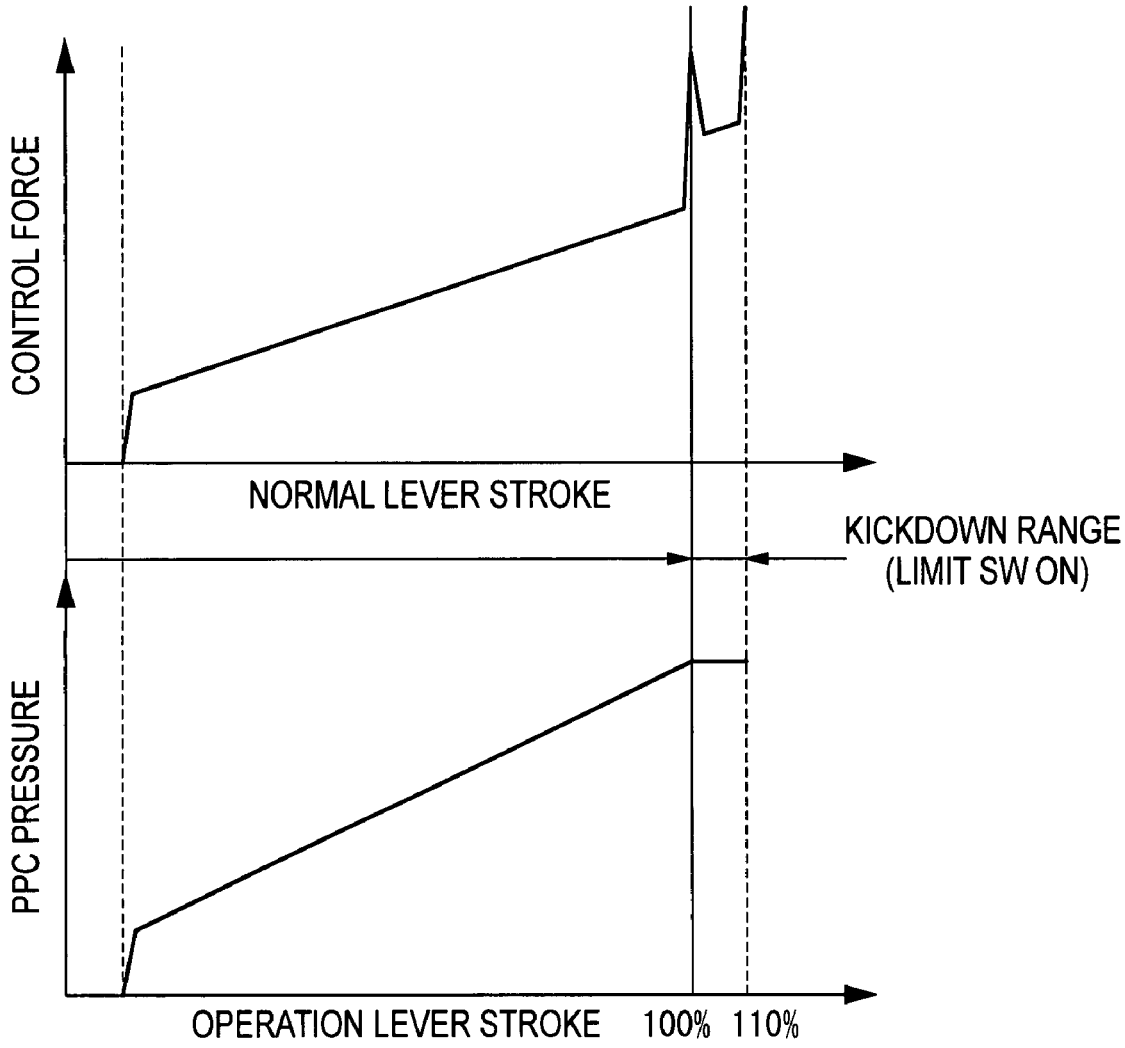
FIG. 2 is an illustration showing a relationship between control force of a control lever and PPC pressure according to the first embodiment.

FIG. 1 is a schematic illustration of a control lever used in the present embodiment. FIG. 2 is an illustration showing output characteristics of control force of the control lever and PPC (Pilot Pressure Control) pressure.

A control lever 22 opens valves V1 and V2 in accordance with operating direction and angle, so that pressure oil from a pilot pump P is fed into pilot lines PT1 and PT2 through the valves V1 and V2.

When the stroke range of a normal control lever is 100%, the control lever 22 can be operated to around 110%. When the operation stroke of the control lever 22 exceeds 100%, an operation feeling is given where the lever does not move without applying further greater control force. For instance, when the operation stroke of the control lever 22 exceeds 100%, movable part of the control lever 22 touches a biasing unit such as a spring, so that a control force greater than the previous control force is required for moving the lever on account of the reaction force of the biasing unit.

A range in which the operation stroke of the control lever 22 exceeds 100% to be around 110% is called as a kickdown range (KDE). When the control lever 22 reaches to the kickdown range, i.e. when the control lever 22 reaches to the proximity of the end of manipulable range, limit switches (detecting means) LS1 and LS2 are turned on, thereby detecting that the control lever 22 has reached to the kickdown range. The PPC pressure output within the kickdown range stays the same.

Figure 3:
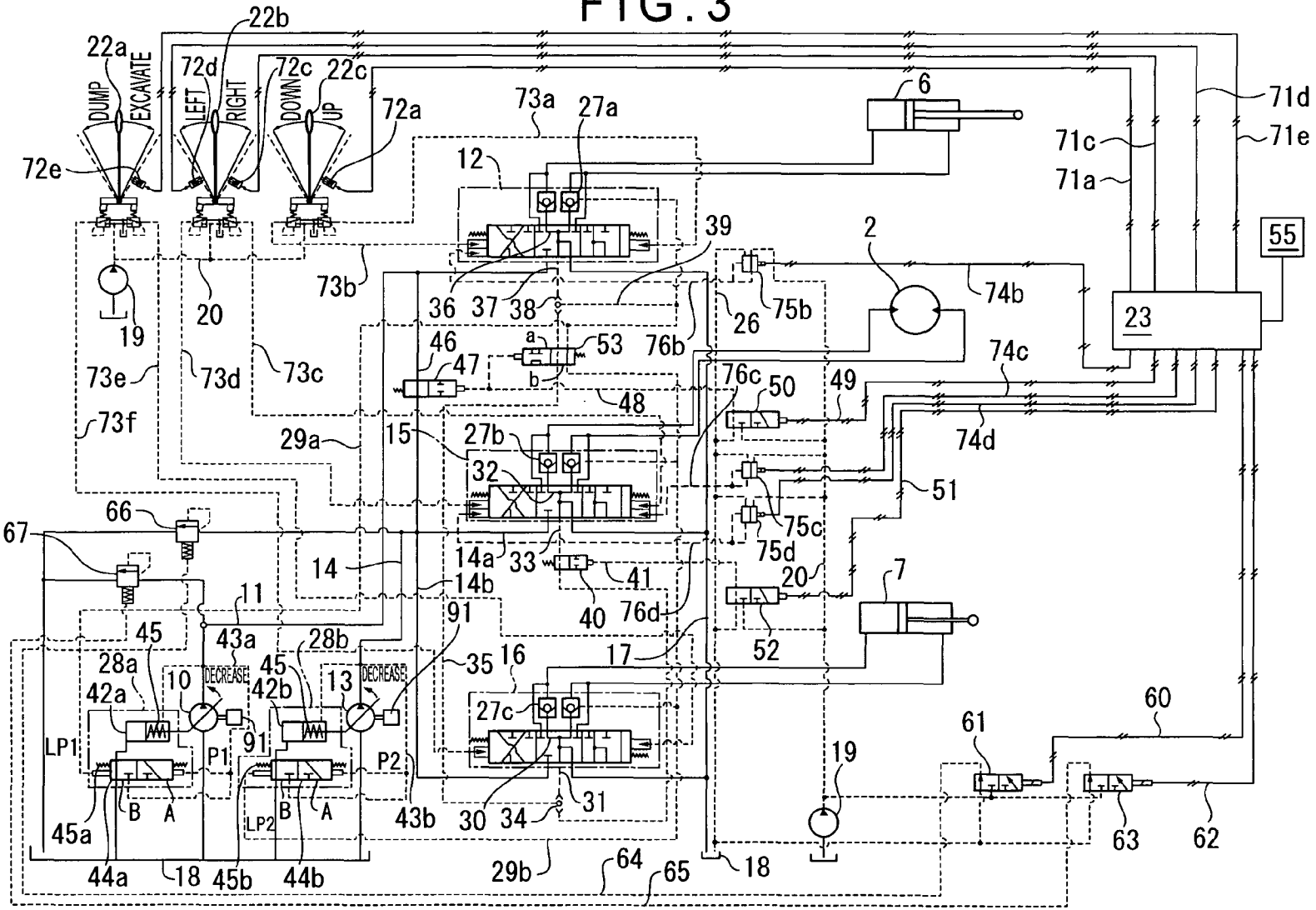
FIG. 3 is a diagram showing a hydraulic control circuit according to the first embodiment.

Among the hydraulic control circuits, a hydraulic control circuit of three hydraulic actuators, i.e. boom-driving hydraulic cylinder (referred to as a boom cylinder hereinafter) 6, arm-driving hydraulic cylinder (referred to as an arm cylinder hereinafter) 7 and swing hydraulic motor 2 according to the present invention, are shown in FIG. 3.

The hydraulic control circuit is a two-pump type including two variable displacement hydraulic pumps 10 and 13. The boom cylinder 6 is connected to a delivery line 11 of the variable displacement hydraulic pump 10 via a pressure compensated flow-control valve 12 for controlling the flow rate and flow direction. A delivery line 14 of the variable displacement hydraulic pump 13 includes two branch lines 14*a* and 14*b*. The swing hydraulic motor 2 is connected to the branch line 14*a* via a pressure compensated flow-control valve 15. The arm cylinder 7 is connected to the branch line 14*b* via a pressure compensated flow-control valve 16.

Incidentally, the variable displacement hydraulic pumps 10 and 13 are driven by an engine 91 (in FIG. 3, though it is illustrated that the engine 91 is connected respectively to the pumps 10 and 13, the pumps 10 and 13 are actually driven by the single engine 91), where the maximum engine speed and maximum power of the engine 91 is controlled by a command signal of a controller 23 through a governor (not shown).

The boom cylinder 6, the arm cylinder 7 and the swing hydraulic motor 2 are connected to the two variable displacement hydraulic pump 10 and 13 in parallel, and are also connected to a reservoir 18 through a return circuit 17.

The pressure compensated flow-control valves 12, 15 and 16 are pilot-operated type. A main line 20 of a pilot pump 19 are connected to both ends of the respective pressure compensated flow-control valves 12, 15 and 16 via pilot lines 73*a* to 73*f* of the respective control levers 22*a*, 22*b* and 22*c*.

A limit switch (second detecting means) 72*a* for detecting that the boom control lever 22*c* reaches to the kickdown range when the boom control lever 22*c* is operated in a boom-lift-up direction is provided on the boom control lever 22*c*; limit switches 72*c* and 72*d* (first detecting means) for detecting that the swing control lever 22*b* reaches to the kickdown range when the swing control lever 22*b* is operated in both right and left rotary directions are provided on the swing control lever 22*b*; and a limit switch 72*e* (third detecting means) for detecting that the arm control lever 22*a* reaches to the kickdown range when the arm control lever 22*a* is operated in an arm excavating direction is provided on the arm control lever 22*a*.

The limit switches 72*a*, 72*c*, 72*d* and 72*e* are connected to the controller 23 via signal circuits 71*a*, 71*c*, 71*d* and 71*e*.

Variable displacement pressure-control valves 67 and 66 are connected to the delivery lines 11 and 14 of the variable displacement hydraulic pumps 10 and 13. When the pilot valves 61 and 63 are switched by a command signal output from the controller 23 through the signal circuits 60 and 62, pilot pressure from the pilot pump 19 is applied to an operating section of the variable pressure-control valves 67 and 66 through pilot lines 64 and 65. Accordingly, maximum pressure (relief pressure) of the delivery lines 11 and 14 of the variable displacement hydraulic pumps 10 and 13 are controlled. Incidentally, 26 denotes a return line of the pilot hydraulic pressure.

The pressure compensated flow-control valves 12, 15 and 16 are provided with a mechanism for restricting a spool stroke within the control valves to control maximum flow rate. When the pilot valves 75*b*, 75*c* and 75*d* are switched by a command signal output from the controller 23 through the signal circuits 74*b*, 74*c* and 74*d*, the pilot pressure from the pilot pump 19 is applied to the operating section of the respective pressure compensated flow-control valves 12 and 15 to restrict the flow rate of the pressure compensated flow-control valves 12 and 15.

The hydraulic pumps 10 and 13, the delivery lines 11 and 14 and the pressure compensated flow-control valves 12, 15 and 16 constitutes a hydraulic circuit (driving means) for driving the hydraulic actuators (the swing hydraulic motor 2, the boom cylinder 6 and the arm cylinder 7).

Pressure compensating valves 27*a*, 27*b* and 27*c* for detecting and compensating discharge pressure of the hydraulic pumps 10 and 13 relative to the required flow rate of the respective actuators (the boom cylinder 6, the arm cylinder 7 and the swing hydraulic motor 2) are provided on the pressure compensated flow-control valves 12, 15 and 16. The pressure compensating valves 27*a*, 27*b* and 27*c* are connected to load sensing regulators 28*a* and 28*b* of the hydraulic pumps 10 and 13 through pilot lines 29*a* and 29*b*.

The load sensing circuit is configured as follows. The pressure on the maximum load pressure side of a pilot line 33 for detecting the maximum load pressure of the swing hydraulic motor 2 from an outlet port 32 of the pressure compensated flow-control valve 15 and a pilot line 31 for detecting the maximum load pressure of the arm cylinder 7 from an output port 30 of the pressure compensated flow-control valve 16 is detected by a shuttle valve 34. The pressure on the maximum load pressure side of a pilot line 35 connected to the shuttle valve 34 and a pilot line 37 for detecting the maximum load pressure of the boom cylinder 6 from the outlet port 36 of the pressure compensated flow-control valve 12 is detected by a shuttle valve 38, which on one hand is input to the load sensing regulator 28*a* of the hydraulic pump 10 through the pilot line 29*a* and on the other hand is input to the load sensing regulator 28*b* of the other hydraulic pump 13 through the pilot line 29*b*.

A swing load sensing switching valve 40 is provided on the load sensing circuit. The switching valve 40 is controllably switched by an electromagnetic pilot valve 52 controlled by a signal circuit 51 of the controller 23 through a pilot line 41.

The load sensing regulators 28*a* and 28*b* respectively include pilot-operated load sensing valves 44*a* and 44*b* provided between the delivery lines 11 and 14 and servo pistons 42*a* and 42*b* for controlling swash-plate inclination of the hydraulic pumps 10 and 13. Pilot lines 29*a* and 43*a* are connected to both ends of one of the load sensing valves 44*a*, and pilot lines 29*b* and 43*b* are connected to both ends of the other load sensing valve 44*b*.

When the sum of the maximum load pressure introduced by the pilot lines 29*a* and 29*b* and spring force of springs 45*a* and 45*b* becomes greater than the discharge pressure of the hydraulic pumps 10 and 13 introduced by the pilot lines 43*a* and 43*b*, the load sensing valves 44*a* and 44*b* switches from (A) position to (B) position to return the pressure oil of the servo pistons 42*a* and 42*b* to the reservoir 18 to increase swash-plate angle of the hydraulic pumps 10 and 13 to augment the discharge flow rate. On the contrary, when the sum of the maximum load pressure and the spring force becomes smaller than the discharge pressure of the hydraulic pumps 10 and 13, the load sensing valves 44*a* and 44*b* switches from the (B) position to the (A) position, so that the pressure oil from the pilot lines 43*a* and 43*b* enters into the servo pistons 42*a* and 42*b* to decrease the swash-plate angle of the hydraulic pumps 10 and 13 to reduce the discharge flow rate.

In other words, the discharge pressure P1 of the hydraulic pump 10 is applied from the line 43*a* to one of the operating sections of the load sensing valve 44*a*, and the load pressure LP1 introduced by the pilot line 29*a* and the spring force are applied on the other operating section of the load sensing valve 44*a*. Accordingly, when P1>LP1, the swash-plate angle of the hydraulic pump 10 is controlled to be decreased, and, when P1<LP1, the swash-plate angle of the hydraulic pump 10 is controlled to be increased.

Further, the discharge pressure P2 of the hydraulic pump 13 is applied from the line 43*a* to one of the operating sections of the load sensing valve 44*b*, and the load pressure LP2 introduced by the pilot line 29*b* and the spring force are applied on the other operating section of the load sensing valve 44*b*. Accordingly, when P2>LP2, the swash-plate angle of the hydraulic pump 13 is controlled to be decreased, and, when P2<LP2, the swash-plate angle of the hydraulic pump 13 is controlled to be increased.

With the use of the above load sensing system and the pressure compensated flow-control valves 12, 15 and 16, while restraining the discharged pressure oil of the hydraulic pumps 10 and 13 to a required flow rate to serve for energy saving, the respective pressure compensating valves 27*a*, 27*b* and 27*c* are controlled by the maximum load pressure of the respective hydraulic actuators (the boom cylinder 6, the arm cylinder 7 and the swing hydraulic motor 2).

The delivery lines 11 and 14 of the two variable displacement hydraulic pumps 10 and 13 are interconnected by a communication line 46. The communication line 46 is provided with a merge/branch switching valve 47 of the discharged pressure oil of both of the hydraulic pumps 10 and 13. The switching valve 47 is controllably switched by pilot pressure of a pilot line 48 in accordance with actuation of an electromagnetic pilot valve 50 commanded by the controller 23 via a signal circuit 49.

Incidentally, a load sensing pressure on/off switching valve 53 controllably interlocked with the merge/branch switching valve 47 is provided in the load sensing circuit.

The hydraulic control circuit having thus arranged load-sensing system is operated under various priority modes set in advance in the controller 23 so that operation matching can be changed by flow-rate distribution for simultaneous operation of the swing mechanism and the boom or arm while excavating earth and sand with lift-up swing and loading into a dumper truck, and instantaneous operation under a predetermined rated power of an engine can be conducted when hard soil is to be excavated.

Figure 4:
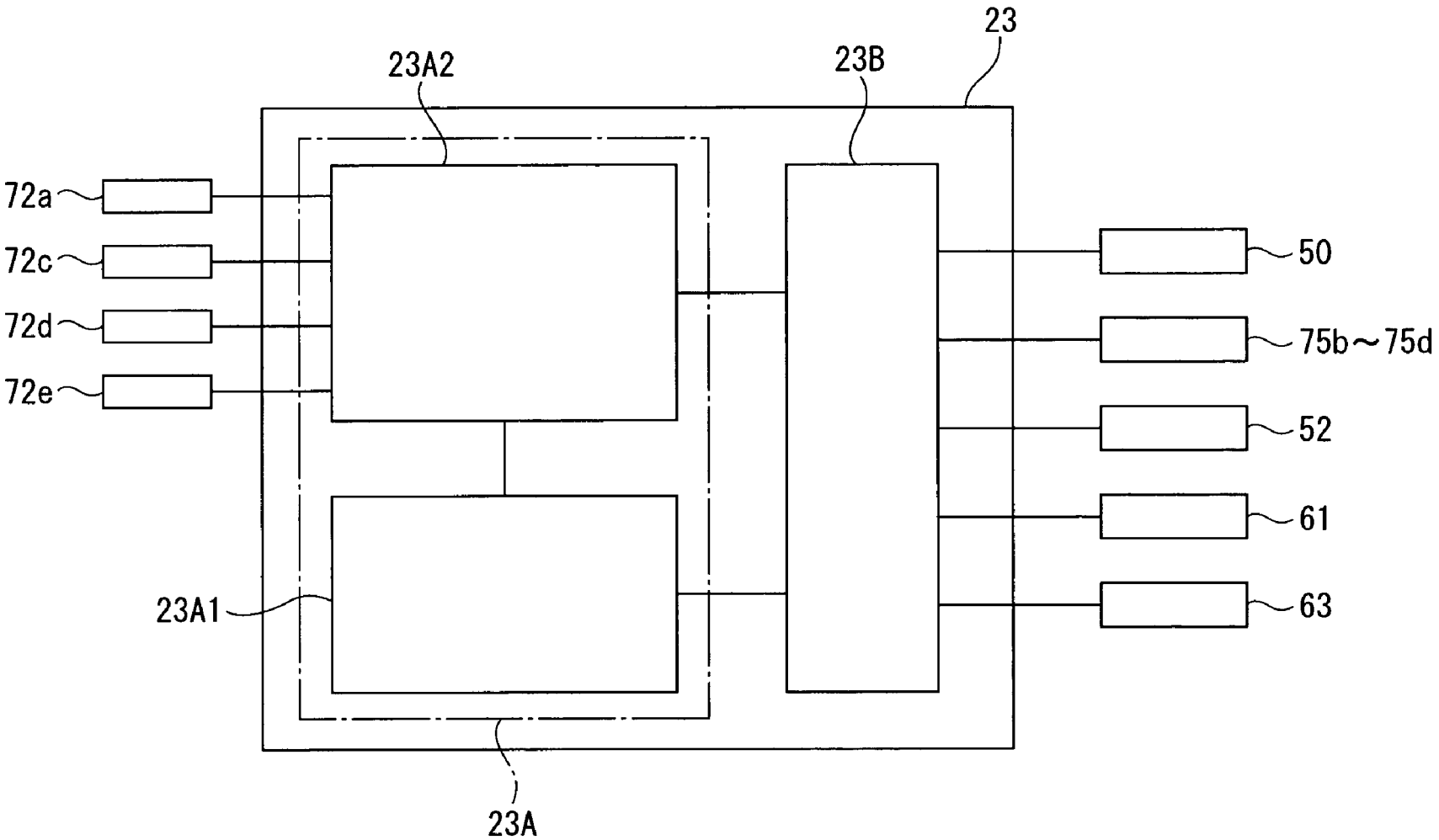
FIG. 4 is a diagram showing an internal arrangement of a controller according to the first embodiment.

Specifically, as shown in FIG. 4, the controller 23 includes: a mode judging unit 23A that judges whether a priority operation mode in which an output of selected one or more of the driving means can be set higher than a normal mode or output ratio can be set higher as compared to the other driving means is taken or not in accordance with the signals from the limit switches 72*a*, 72*c*, 72*d* and 72*e* provided on the respective control levers 22*a*, 22*b* and 22*c*; and a drive controlling means 23B that controls the driving means so that, when the mode judging unit 23A judges that the priority operation mode is taken, an output of selected one or more of the driving means corresponding to the priority operation mode is set higher than that in the normal mode or the output ratio is set higher as compared to the other driving means.

The mode judging unit 23A includes a storing means 23A1 that stores a plurality of priority operation modes in accordance with the combination of on/off conditions of the limit switches 72*a*, 72*c*, 72*d* and 72*e*, and a selecting means 23A2 that selects a priority operation mode corresponding to the combination of on/off conditions of the limit switches 72*a*, 72*c*, 72*d* and 72*e* from the storing means 23A1.

The drive controlling means 23B transmit a command signal to the pilot valve 50, the pilot valves 75*b* to 75*d*, the pilot valve 52 and the pilot valves 61 and 63 in accordance with the priority operation mode selected by the mode judging unit 23A to perform the priority operation mode.

In accordance with the combination of on/off conditions of the limit switches 72*a*, 72*c*, 72*d* and 72*e*, (I) standard operation mode and seven priority operation modes, i.e. (II) excavating power-up mode, (III) swing priority mode, (IV) boom lift-up priority mode, (V) arm excavation priority mode, (VI) power-up mode (swing+boom), (VII) power-up mode (boom+arm) and (VIII) power-up mode (swing+arm) are stored in the storing means 23A1 as shown in FIG. 5. Further, in accordance with the respective modes, the condition of the merge/branch switching valve 47, the swing load sensing switching valve 40, variable pressure-control valves 67 and 66 and the pilot valves 75*b*, 75*c* and 75*d* that restrict maximum flow rate of the respective flow-control valves 12, 15 and 16, and the speed/power condition of the engine are stored corresponding to the respective modes.

Incidentally, 55 denotes a monitor, on which respective operation modes are displayed.

(1) Standard Mode

When (1) ninety-degree swing operation and boom-lift-up operation are simultaneously conducted and (2) approximately the same flow rate is desired without giving priority to one of the swinging movement and the boom movement and instantaneous increase in excavating force and engine power is not necessary, the respective control levers 22*a*, 22*b* and 22*c* are operated within a normal stroke range. In other words, the control levers are used without reaching to the kickdown range.

Under the above condition, the command signal from the controller 23 is not transmitted to the pilot valve 50. Accordingly, since the pilot valve 50 is located at the position shown in FIG. 3, the pilot pressure applied on the operating section of the merge/branch switching valve 47 is drained from the pilot line 48 to the reservoir 18 and the merge/branch switching valve 47 is off-driven to be positioned at a merge position shown in FIG. 3. In other words, the pressure oil from the hydraulic pump 10 and the pressure oil from the hydraulic pump 13 are merged through the merge/branch switching valve 47.

When the boom control lever 22*c* is operated under this condition, the pressure oil from the pilot pump 19 is applied to the operating section of the pressure compensated flow-control valve 12 through the pilot lines 73*a* and 73*b* to advance and retract the boom cylinder 6. In other words, the boom is lifted up and down.

When the swing lever 22*b* is operated, the pressure oil from the pilot pump 19 is applied to the operating section of the pressure compensated flow-control valve 15 through the pilot lines 73*c* and 73*d*. Consequently, the swing hydraulic motor 2 is turned clockwise and counterclockwise. In other words, swinging movement is conducted.

When the arm control lever 22*a* is operated, the pressure oil from the pilot pump 19 is applied to the operating section of the pressure compensated flow-control valve 16 through the pilot lines 73*e* and 73*f* to advance and retract the arm cylinder 7.

On the other hand, the command signal from the controller 23 is transmitted to the pilot valve 52 in the standard mode. Then, since the pilot valve 52 is switched, the pilot pressure from the pilot pump 19 is applied to the operating section of the swing load sensing switching valve 40 from the pilot line 41 through the pilot valve 52, so that the swing load sensing switching valve 40 is on-driven to be at "cutoff" position.

Accordingly, the load pressure for driving the swing hydraulic motor 2 is blocked by the swing load sensing switching valve 40, the load pressure of the boom cylinder 6 is detected by the shuttle valve 38. The load pressure is applied to the load sensing valve 44*a* through the pilot line 29*a* and is also applied to the operating section of the load sensing valve 44*b* through the pilot line 29*b*.

Accordingly, the discharge pressure P1 of the hydraulic pump 10 is applied from the line 43*a* to one of the operating sections of the load sensing valve 44*a*, and the load pressure LP1 introduced by the pilot line 29*a* and the spring force are applied on the other operating section of the load sensing valve 44*a*. As a result, when P1>LP1, the swash-plate angle of the hydraulic pump 10 is controlled to be decreased, and, when P1<LP1, the swash-plate angle of the hydraulic pump 10 is controlled to be increased.

Further, the discharge pressure P2 of the hydraulic pump 13 is applied from the line 43*a* to one of the operating sections of the load sensing valve 44*b*, and the load pressure LP2 of the boom cylinder 6 introduced by the pilot line 29*b* and the spring force are applied on the other operating section of the load sensing valve 44*b*. As a result, when P2>LP2, the swash-plate angle of the hydraulic pump 13 is controlled to be decreased, and, when P2<LP2, the swash-plate angle of the hydraulic pump 13 is controlled to be increased.

In other words, when the boom and swing mechanism are simultaneously operated in the standard mode, the swash-plate angle of the hydraulic pumps 10 and 13 are controlled to correspond to the load pressure of the boom actuator (the boom cylinder 6) to supply required flow to the respective actuators of the boom and the swing mechanisms (the boom cylinder 6 and the swing hydraulic motor 2).

(II) Excavating Power-Up Mode (Single Operation)

For instance, when the arm is solely operated for excavation, the arm control lever 22*a* is operated to the kickdown range beyond the normal range.

Accordingly, a command signal from the controller 23 is transmitted to the pilot valve 61. Then, the pilot valve 61 is switched and the pilot pressure from the pilot pump 19 is applied to the operating section of the variable pressure-control valve 66 from the pilot line 64 through the pilot valve 61. As a result, the variable pressure-control valve 66 is on-driven to be located at boost position. In other words, the drive hydraulic circuit of the arm cylinder 7 is boosted (110% boosted relative to rated pressure), so that excavating force can be temporarily increased during the operation.

Similarly, when the swing mechanism is solely operated, the swing control lever 22*b* is manipulated to the kickdown range beyond the normal range for temporarily increasing the swing power during the operation.

Further, when the boom is solely lifted up, the boom control lever 22*c* is manipulated to the kickdown range beyond the normal range.

Accordingly, a command signal from the controller 23 is transmitted to the pilot valve 63. Then, the pilot valve 63 is switched and the pilot pressure from the pilot pump 19 is applied to the operating section of the variable pressure-control valve 67 from the pilot line 65 through the pilot valve 63. As a result, the variable pressure-control valve 67 is on-driven to be located at boost position. In other words, the drive hydraulic circuit of the boom cylinder 6 is boosted (110% boosted relative to rated pressure), so that boom-lifting force can be temporarily increased during the operation.

(III) Swing Priority Mode (Swinging Force and Speed Up)

For instance, when (1) one-hundred-eighty degree swing and boom lift-up are simultaneously conducted and (2) load pressure on the swing hydraulic motor 2 is great and large amount of flow is necessary or temporary increase in swinging force is required for operation, only the swing control lever 22*b* is solely manipulated to the kickdown range beyond the normal range.

Accordingly, a command signal from the controller 23 is transmitted to the pilot valve 50. Then, the pilot valve 50 is switched and the pilot pressure from the pilot pump 19 is applied to the operating section of the merge/branch switching valve 47 from the pilot line 48 through the pilot valve 50. As a result, the merge/branch switching valve 47 is on-driven to be located at branch position.

At this time, the pilot pressure from the pilot pump 19 is applied to the operating section of the load sensing pressure on/off switching valve 53 to switch the load sensing pressure on/off switching valve 53 to "a" position.

Simultaneously, a command signal from the controller 23 is transmitted to the pilot valve 75*b*. Then, the pilot valve 75*b* is switched and the pilot pressure from the pilot pump 19 is applied to lowering side operating section of the pressure compensated flow-control valve 12 from the pilot valve 75*b*. As a result, raising-side spool stroke in the pressure compensated flow-control valve 12 is restricted, thereby regulating boom-raising side flow rate.

Further, a command signal from the controller 23 is transmitted to the pilot valve 61. Then, the pilot valve 61 is switched and the pilot pressure from the pilot pump 19 is applied to the operating section of the variable pressure-control valve 66 from the pilot line 64 through the pilot valve 61. As a result, the variable pressure-control valve 66 is on-driven to be located at boost position. In other words, the drive hydraulic circuit of the swing hydraulic motor 2 is boosted (110% boost relative to rated pressure), so that only the swing force can be temporarily increased for simultaneously conducting the swing operation and boom-lift-up operation.

On the other hand, the command signal from the controller 23 is not transmitted to the pilot valve 52. Accordingly, the pilot pressure applied to the pilot valve 52 is drained from the line 41 to the reservoir 18, so that the pilot valve 52 is off-driven to be switched to "link" position shown in FIG. 3.

Accordingly, the load pressure for driving the swing hydraulic motor 2 is applied to the operating section of the load sensing valve 44*b* through the swing load sensing switching valve 40, the shuttle valve 34, the pilot line 35, "a" position of the load sensing pressure on/off switching valve 53 and the pilot line 29*b*.

Accordingly, the discharge pressure P2 of the hydraulic pump 13 is applied from the line 43*a* to one of the operating sections of the load sensing valve 44*b*, and the load pressure LP2 of the swing hydraulic motor 2 introduced by the pilot line 29*b* and the spring force are applied on the other operating section of the load sensing valve 44*b*. As a result, when P2>LP2, the swash-plate angle of the hydraulic pump 13 is controlled to be decreased, and, when P2<LP2, the swash-plate angle of the hydraulic pump 13 is controlled to be increased.

Accordingly, when the swing priority mode is selected, the hydraulic pump 13 independently supplies required flow rate to the swing hydraulic motor 2 and the drive circuit pressure can be boosted. In this case, the boom cylinder 6 is controlled based on differential pressure between the discharge pressure P1 and the load pressure LP1 as in the above standard mode. However, since the spool stroke of the pressure compensated flow-control valve 12 is restricted, the flow rate from the hydraulic pump 10 is also restricted.

In other words, when the boom movement and swing movement are simultaneously conducted in the swing priority mode, the flow rate from the hydraulic pump 10 to the boom actuator (boom cylinder 6) is regulated, and since the swash-plate angle of the hydraulic pump 13 is regulated corresponding to the load pressure simultaneously with the boosting of the drive hydraulic circuit of the swing actuator (swing hydraulic motor 2), the drive force and required flow rate of the swing hydraulic motor 2 are augmented.

(IV) Boom-Up Priority Mode (Boom-Up Excavating Force and Speed Up)

For instance, when the swing operation and the boom-up operation are simultaneously conducted and (1) swing angle is relatively small (forty-five degrees for instance) and (2) large amount of flow rate is required for boom-up operation or temporary increase in boom-up force is required for operation, only the boom control lever 22*c* is manipulated to the kickdown range beyond the normal range.

Accordingly, a command signal from the controller 23 is transmitted to the pilot valve 50. Then, the pilot valve 50 is switched and the pilot pressure from the pilot pump 19 is applied to the operating section of the merge/branch switching valve 47 from the pilot line 48 through the pilot valve 50. As a result, the branch switching valve 47 is on-driven to be located at branch position.

At this time, the pilot pressure from the pilot pump 19 is applied to the operating section of the load sensing pressure on/off switching valve 53 to switch the load sensing pressure on/off switching valve 53 to "a" position.

Simultaneously, a command signal from the controller 23 is transmitted to the pilot valve 52. Then, the pilot valve 52 is switched and the pilot pressure from the pilot pump 19 is applied to the operating section of the swing load sensing switching valve 40 from the pilot line 41 through the pilot valve 52. As a result, the load pressure for driving the swing hydraulic motor 2 is blocked by the swing load sensing switching valve 40.

Further, the command signal from the controller 23 is transmitted to the pilot valve 75*c* or the pilot valve 75*d*. Then, the pilot valve 75*c* or the pilot valve 75*d* is switched, so that the pilot pressure from the pilot pump 19 is applied from the pilot valve 75*c* or the pilot valve 75*d* to the side opposite to the driving side operating section of the pressure compensated flow-control valve 15. As a result, driving-side spool stroke inside the pressure compensated flow-control valve 15 is restricted to regulate the swing flow rate.

Further, a command signal from the controller 23 is transmitted to the pilot valve 63. Then, the pilot valve 63 is switched and the pilot pressure from the pilot pump 19 is applied to the operating section of the variable pressure-control valve 67 from the pilot line 65 through the pilot valve 63. As a result, the variable pressure-control valve 67 is on-driven to be located at boost position.

In other words, the drive hydraulic circuit of the boom cylinder 6 is boosted (110% boost relative to rated pressure), so that only the boom-up force can be temporarily increased for simultaneously conducting the swing operation and boom-lift-up operation.

On the other hand, the load pressure of the boom cylinder 6 is applied to the operating section of the load sensing valve 44*a* through the pilot line 29*a*, and the load pressure of the swing hydraulic motor 2 is not applied to the operating section of the load sensing valve 44*b*.

Accordingly, the discharge pressure P1 of the hydraulic pump 10 is applied from the line 43*a* to one of the operating sections of the load sensing valve 44*a*, and the load pressure P1 introduced by the pilot line 29*a* and the spring force are applied on the other operating section of the load sensing valve 44*a*. As a result, when P1 (discharge pressure of hydraulic pump 10)>LP1 (load pressure of the boom cylinder), the swash-plate angle of the hydraulic pump 10 is controlled to be decreased, and, when P1<LP1, the swash-plate angle of the hydraulic pump 10 is controlled to be increased.

Further, when the load pressure from the swing hydraulic motor 2 is not applied to the load sensing valve 44*b*, the load sensing valve 44*b* is controlled by the discharge pressure P2 of the hydraulic pump 13. When the discharge pressure P2 becomes greater than the spring force, the swash-angle plate is controlled to be decreased.

Accordingly, when the boom-up operation and the swing operation are simultaneously conducted in the boom-up priority mode, the flow rate from the hydraulic pump 13 to the swing actuator (swing hydraulic motor 2) is regulated, and, simultaneously with the boosting of the drive hydraulic circuit of the boom actuator (boom cylinder 6), the swash-plate angle of the hydraulic pump 10 is controlled corresponding to the load pressure, so that drive force and required flow rate of the boom cylinder 6 are augmented.

Incidentally, when the arm cylinder 7 is driven, the load pressure of the arm is applied to the operating section of the load sensing valve 44*b* through the shuttle valve 34, the pilot line 35, the "a" position of the switching valve 53 and the pilot line 29*b*. Accordingly, when P2>LP2, the swash-plate angle of the hydraulic pump 13 is controlled to be decreased, and, when P2<LP2, the swash-plate angle of the hydraulic pump 13 is controlled to be increased, so that required flow rate can be supplied to the arm cylinder 7.

(V) Arm Excavation Priority Mode (Arm Excavating Power and Speed Up)

For instance, when arm-excavation operation and boom-up operation are simultaneously conducted for rough finish and (1) arm-excavation speed has to be accelerated or (2) only arm excavating power is temporarily increased, only the arm control lever 22*a* is manipulated to the kickdown range beyond the normal range.

Accordingly, a command signal from the controller 23 is transmitted to the pilot valve 50. Then, the pilot valve 50 is switched and the pilot pressure from the pilot pump 19 is applied to the operating section of the merge/branch switching valve 47 from the pilot line 48 through the pilot valve 50. As a result, the branch switching valve 47 is on-driven to be located at branch position.

At this time, the pilot pressure from the pilot pump 19 is applied to the operating section of the load sensing pressure on/off switching valve 53 to switch the load sensing pressure on/off switching valve 53 to "a" position.

Simultaneously, a command signal from the controller 23 is transmitted to the pilot valve 52. Then, the pilot valve 52 is switched and the pilot pressure from the pilot pump 19 is applied to the operating section of the swing load sensing switching valve 40 from the pilot line 41 through the pilot valve 52. As a result, the load pressure for driving the swing hydraulic motor 2 is blocked by the swing load sensing switching valve 40.

Further, a command signal from the controller 23 is transmitted to the pilot valve 75. Then, the pilot valve 75*b* is switched and the pilot pressure from the pilot pump 19 is applied to the lowering side operating section of the pressure compensated flow-control valve 12 from the pilot valve 75*b*. As a result, the raising-side spool stroke in the pressure compensated flow-control valve 12 is restricted, thereby regulating the boom-raising side flow rate.

Further, a command signal from the controller 23 is transmitted to the pilot valve 61. Then, the pilot valve 61 is switched and the pilot pressure from the pilot pump 19 is applied to the operating section of the variable pressure-control valve 66 from the pilot line 64 through the pilot valve 61. As a result, the variable pressure-control valve 66 is on-driven to be located at boost position.

In other words, the drive hydraulic circuit of the arm cylinder 7 is boosted (110% boost relative to rated pressure), so that only the arm-excavating force can be temporarily increased for simultaneously conducting the arm excavating operation and boom-lift-up operation.

On the other hand, the load pressure of the arm cylinder 7 is applied to the operating section of the load sensing valve 44*b* through the pilot line 29*b*, and the load pressure of the swing hydraulic motor 2 is not applied to the operating section of the load sensing valve 44*b*.

Accordingly, the discharge pressure P2 of the hydraulic pump 13 is applied from the line 43*a* to one of the operating sections of the load sensing valve 44*b*, and the load pressure LP2 of the arm cylinder 7 introduced by the pilot line 29*b* and the spring force are applied on the other operating section of the load sensing valve 44*b*.

As a result, when P2 (discharge pressure of hydraulic pump 13)>LP2 (load pressure of the arm cylinder 7), the swash-plate angle of the hydraulic pump 13 is controlled to be decreased, and, when P2<LP2, the swash-plate angle of the hydraulic pump 13 is controlled to be increased.

In other words, when the boom-up movement and arm-excavation are simultaneously conducted in the arm-excavation priority mode, the flow rate from the hydraulic pump 10 to the boom actuator (boom cylinder 6) is regulated, and since the swash-plate angle of the hydraulic pump 13 is regulated corresponding to the load pressure simultaneously with the boosting of the drive hydraulic circuit of the arm actuator (arm cylinder 7), the drive force and required flow rate of the arm cylinder 7 are augmented.

(VI) Power-Up Mode (Swing+Boom-Up)

In some cases, it is desirable to increase power for rapid loading operation and the like. For instance, when large amount of flow is required to both actuators in order to simultaneously accelerate the boom-up speed and the swing speed, the swing control lever 22*b* and the boom control lever 22*c* are manipulated to the kickdown range beyond the normal range.

Under the above condition, the command signal from the controller 23 is not transmitted to the pilot valve 50. Accordingly, since the pilot valve 50 is located at the position shown in FIG. 3, the pilot pressure applied on the operating section of the merge/branch switching valve 47 is drained from the pilot line 48 to the reservoir 18 and the merge/branch switching valve 47 is off-driven to be positioned at a merge position shown in FIG. 3. In other words, the pressure oil from the hydraulic pump 10 and the pressure oil from the hydraulic pump 13 are merged through the merge/branch switching valve 47.

On the other hand, a command signal from the controller 23 is transmitted to the pilot valve 52. Then, the pilot valve 52 is switched and the pilot pressure from the pilot pump 19 is applied to the operating section of the swing load sensing switching valve 40 from the pilot line 41 through the pilot valve 52. As a result, the load pressure for driving the swing hydraulic motor 2 is blocked by the swing load sensing switching valve 40.

Simultaneously, a command signal from the controller 23 is transmitted to the pilot valves 61 and 63. Then, the pilot valves 61 and 63 are switched and the pilot pressure from the pilot pump 19 is applied to the operating section of the variable pressure-control valves 66 and 67 from the pilot lines 64 and 65 through the pilot valves 61 and 63. As a result, the variable pressure-control valves 66 and 67 are on-driven to be located at boost position.

Further, the command signal from the controller 23 is transmitted to a governor (not shown) for controlling the speed and power of the engine for driving the hydraulic pumps 10 and 13. Then, the speed and power of the engine is controlled to be raised (about 100% relative to rated speed and power).

In other words, the speed and power of the engine for driving the hydraulic pumps 10 and 13 are increased, the boom-up speed and swing speed can be simultaneously raised in the loading operation and the like, so that loading operation can be speedily conducted.

On the other hand, the load pressure of the arm cylinder 7 is applied to the operating section of the load sensing valve 44*b* through the pilot line 29*b*, and the load pressure of the swing hydraulic motor 2 is not applied to the operating section of the load sensing valve 44*b*.

Accordingly, the discharge pressure P2 of the hydraulic pump 13 is applied from the line 43*a* to one of the operating sections of the load sensing valve 44*b*, and the load pressure LP2 of the arm cylinder 7 introduced by the pilot line 29*b* and the spring force are applied on the other operating section of the load sensing valve 44*b*. As a result, when differential pressure of the discharge pressure P2 of hydraulic pump 13 and the load pressure LP2 of the arm cylinder 7 is P2>LP2, the swash-plate angle of the hydraulic pump 13 is controlled to be decreased, and, when P2<LP2, the swash-plate angle of the hydraulic pump 13 is controlled to be increased.

(VII) Power-Up Mode (Boom-Up+Arm-Excavation)

Similarly, large amount of flow is required to both actuators in order to simultaneously accelerate the boom-up speed and the arm-excavation speed, the boom control lever 22*c* and the arm control lever 22*a* are manipulated to the kickdown range beyond the normal range.

Under the above condition, the command signal from the controller 23 is not transmitted to the pilot valve 50. Accordingly, since the pilot valve 50 is located at the position shown in FIG. 3, the pilot pressure applied on the operating section of the merge/branch switching valve 47 is drained from the pilot line 48 to the reservoir 18 and the merge/branch switching valve 47 is off-driven to be positioned at a merge position shown in FIG. 3. In other words, the pressure oil from the hydraulic pump 10 and the pressure oil from the hydraulic pump 13 are merged through the merge/branch switching valve 47.

On the other hand, a command signal from the controller 23 is transmitted to the pilot valve 52. Then, the pilot valve 52 is switched and the pilot pressure from the pilot pump 19 is applied to the operating section of the swing load sensing switching valve 40 from the pilot line 41 through the pilot valve 52. As a result, the load pressure for driving the swing hydraulic motor 2 is blocked by the swing load sensing switching valve 40.

Simultaneously, a command signal from the controller 23 is transmitted to the pilot valves 61 and 63. Then, the pilot valves 61 and 63 are switched and the pilot pressure from the pilot pump 19 is applied to the operating section of the variable pressure-control valves 66 and 67 from the pilot lines 64 and 65 through the pilot valves 61 and 63. As a result, the variable pressure-control valves 66 and 67 are on-driven to be located at boost position.

Further, the command signal from the controller 23 is transmitted to a governor (not shown) for controlling the speed and power of the engine 91 for driving the hydraulic pumps 10 and 13. Then, the speed and power of the engine 91 is controlled to be raised (about 100% relative to rated speed and power).

In other words, since the speed and power of the engine 91 for driving the hydraulic pump 10 and 13 increase, the boom-up speed and the arm-excavation speed can be simultaneously accelerated, so that excavation operation and the like can be speedily conducted.

Incidentally, since the swash-plate angle control of the hydraulic pumps 10 and 13 is the same as the effect of the above-described (VI), explanation thereof is omitted.

(VIII) Power-Up Mode (Swing+Arm Excavation)

When large amount of flow is required on both of the actuators for simultaneously increasing arm-excavation speed and swing speed in order to temporarily increase the power for speedy swing ground-smoothing and the like, the arm control lever 22*a* and the swing control lever 22*b* are manipulated to the kickdown range beyond the normal range.

The effect of the above arrangement is the same as the effect of the above-described (VI) and the explanation thereof is not described.

Modification of First Embodiment

Though one limit switch 72*a* is provided on the boom control lever 22*c*, two limit switches 72*c* and 72*d* are provided on the swing control lever 22*b* and one limit switch 72*e* is provided on the arm control lever 22*a*, a bucket control lever may be provided in addition to the boom control lever 22*c*, the swing control lever 22*b* and the arm control lever 22*a* and two limit switches for detecting the kickdown range may be provided to the control levers to set the priority operation modes in accordance with the combination of on/off conditions of the limit switches.

For instance, as shown in FIG. 6, excavating power up mode, boom priority mode, arm priority mode, bucket priority mode, swing priority mode and power-up mode may be set in accordance with the combination of on/off conditions of boom switch BSW1 (up, down), arm switch ASW (excavation, dump), bucket switch BSW2 (excavation, dump) and swing switch TSW (right, left), and corresponding mode may be selected and executed based on the combination of on/off conditions of the switch.

Figure 7:
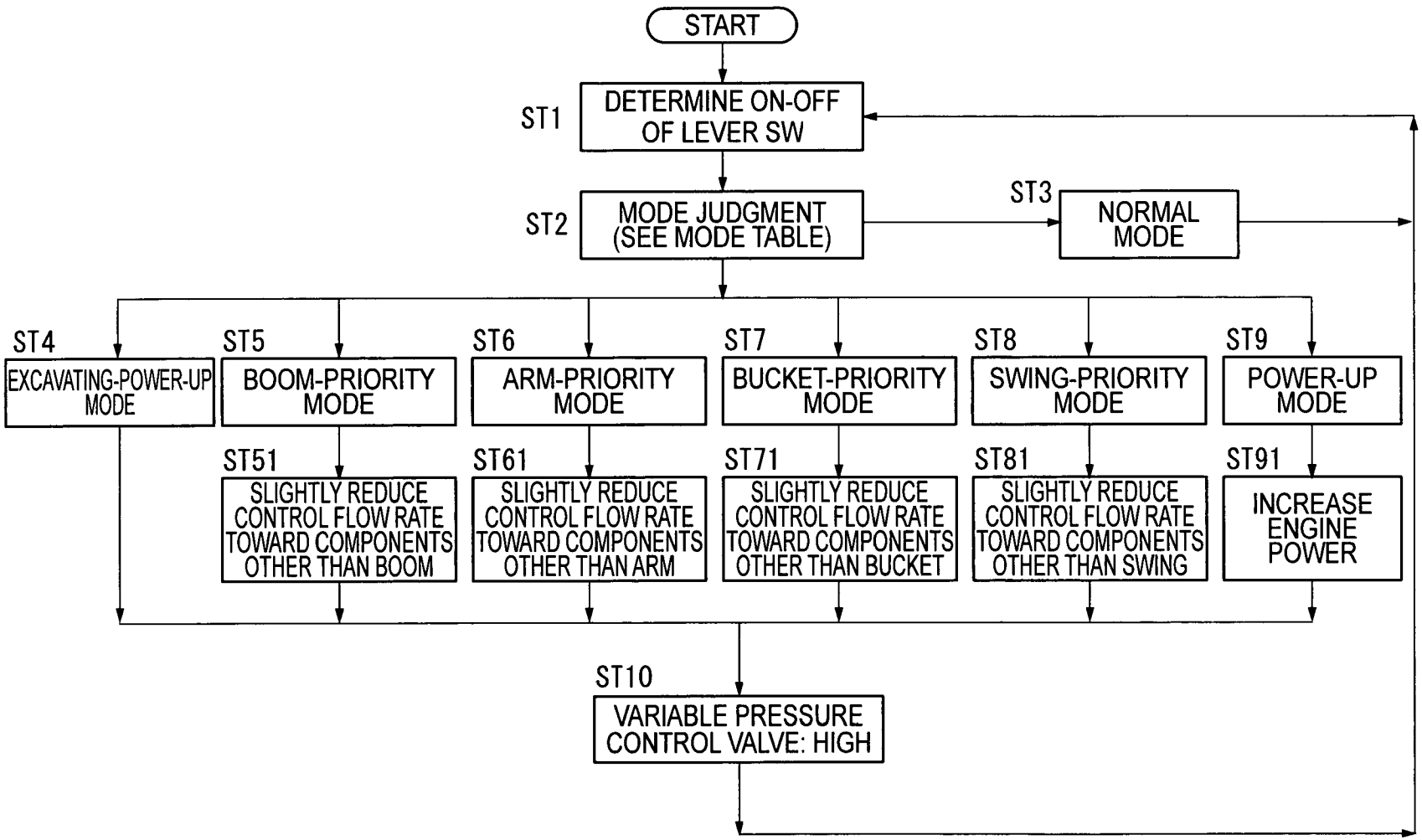
FIG. 7 is a flowchart of the above modification.

During execution process, as shown in FIG. 7, after on/off conditions of the switches are determined (ST1), the mode is judged based on the combination of the on/off conditions of the switches (ST2). Specifically, whether the combination of the on/off conditions of the switches is included in the designated modes shown in FIG. 6 or not is judged. When the combination is not included in the designated operation modes, normal operation is conducted as the standard mode (normal mode) (ST3).

When the combination can be found in the designated operation modes, the process goes to either one of excavating power-up mode (ST4), boom priority mode (ST5), arm priority mode (ST6), bucket priority mode (ST7), swing priority mode (ST8) and power-up mode (ST9).

Subsequently to the excavating power-up mode (ST4), the variable pressure-control valve is boosted (ST10). Specifically, the variable pressure-control valves 66 and 67 are switched to the boost position.

In the boom priority mode (ST5), after control flow rate other than the boom is slightly reduced in the respective driving hydraulic circuits, the process of ST10 is conducted. In the arm priority mode (ST6), after control flow rate other than the arm is slightly reduced in the respective driving hydraulic circuits, the process of ST10 is conducted. In the bucket priority mode (ST7), after control flow rate other than the bucket is slightly reduced in the respective driving hydraulic circuits, the process of ST10 is conducted. In the swing priority mode (ST8), after control flow rate other than the swing mechanism is slightly reduced in the respective driving hydraulic circuits, the process of ST10 is conducted. In the power-up mode (ST9), after raising the power of the engine 91, the process of ST10 is conducted.

In the above examples, since the control flow rate of the drive hydraulic circuit other than the selected priority operation mode is restrained to increase the control flow rate of the hydraulic circuit corresponding to the selected priority operation mode relative to the control flow rate of the other hydraulic circuits. Consequently, priority is given to the hydraulic circuit corresponding to the selected priority operation mode. In this arrangement, existing hydraulic circuit can be used for implementing the present invention.

Second Embodiment

Figure 8:
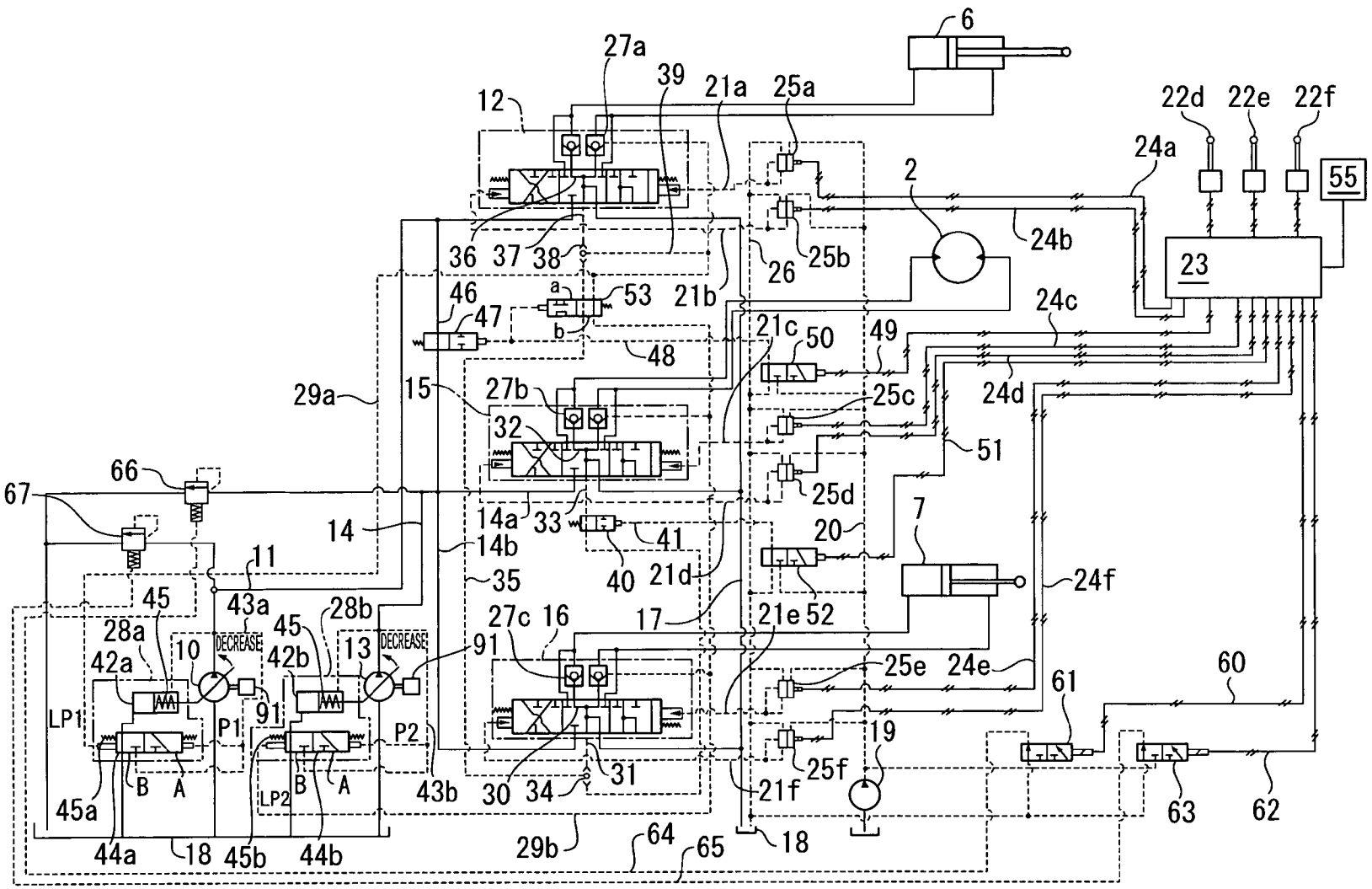
FIG. 8 is a diagram showing a hydraulic control circuit according to a second embodiment of the invention.

FIG. 8 shows a hydraulic control circuit of a hydraulic excavator according to second embodiment of the invention. The hydraulic control circuit of the present embodiment differs from the hydraulic control circuit of the first embodiment in the following.

The PPC type control levers 22*a*, 22*b* and 22*c*, the limit switches 72*a*, 72*c* and 72*d*, the main line 20 and the pilot lines 73*a*, 73*b*, 73*c*, 73*d*, 73*e* and 73*f* are omitted from the first embodiment and electric control levers 22*d*, 22*e* and 22*f* are provided in place thereof. In this connection, pilot valves (electromagnetic proportional control valve) 25*a*, 25*b*, 25*c*, 25*d*, 25*e* and 25*f* are provided to the controller 23 via signal circuits 24*a*, 24*b*, 24*c*, 24*d*, 24*e* and 24*f*, the pilot valves 25*a*, 25*b*, 25*c*, 25*d*, 25*e* and 25*f* being connected to both ends of the pressure compensated flow-control valves 12, 15 and 16.

Figure 9:
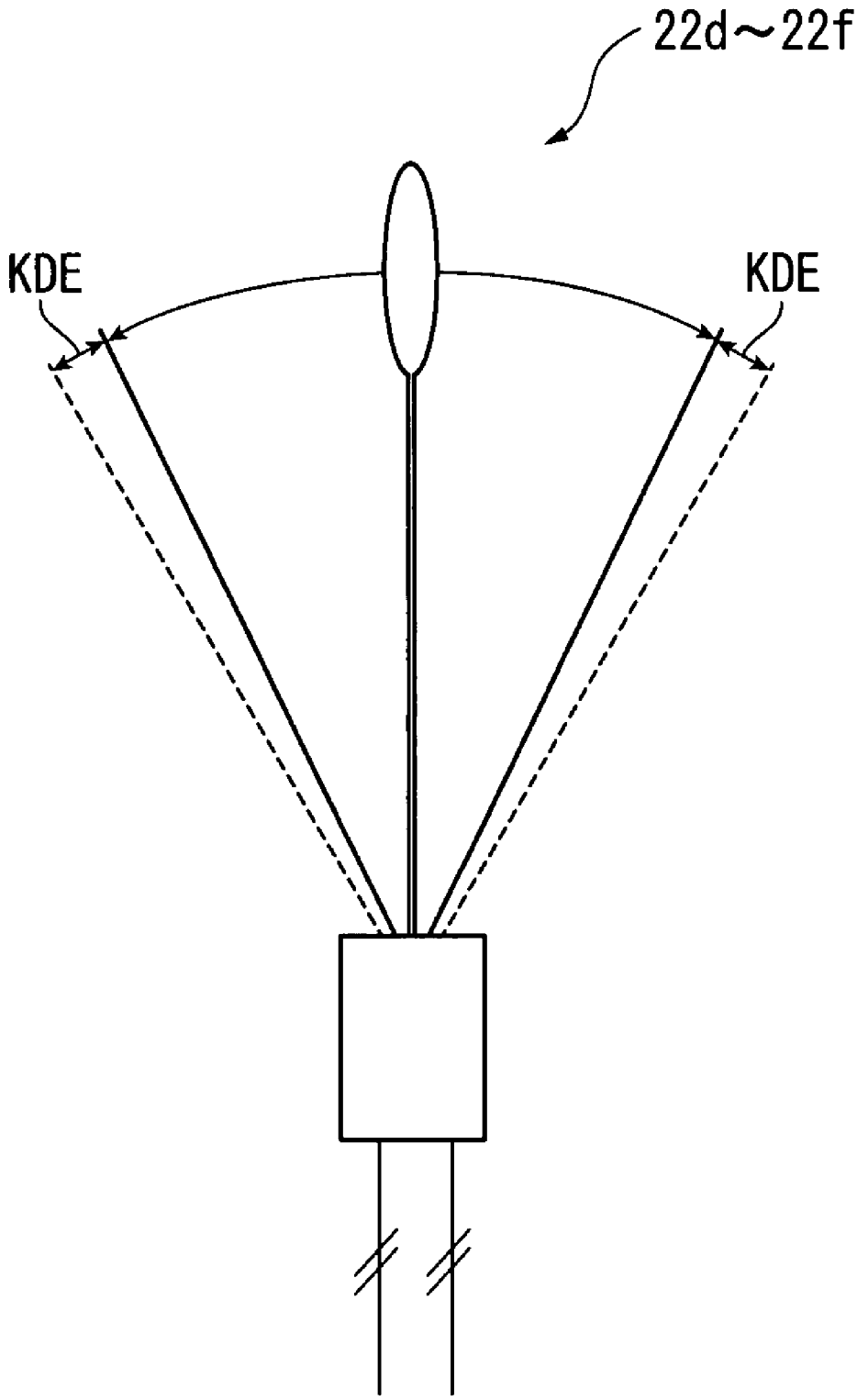
FIG. 9 is a schematic illustration of a control lever according to the second embodiment.
Figure 10:
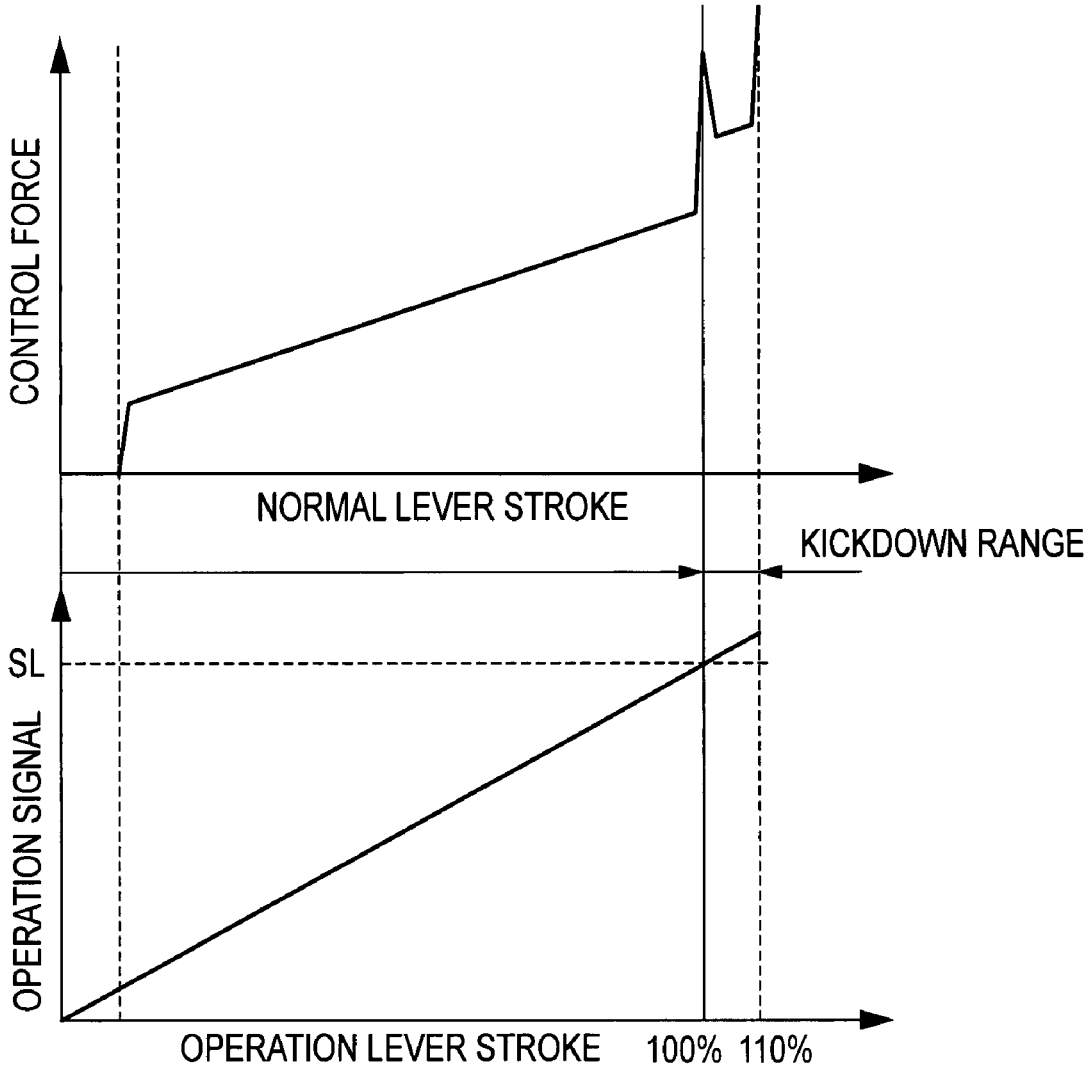
FIG. 10 is an illustration showing a relationship between control force of a control lever and an output signal according to the second embodiment.

As shown in FIGS. 9 and 10, the electric control levers 22*d*, 22*e* and 22*f* are manipulable to a range approximately 110% (kickdown range) relative to stroke range of normal control lever (100%) in the same manner as the control levers 22*a*, 22*b* and 22*c* used in the first embodiment. When the operation stroke of the control lever 22 exceeds 100%, an operation feeling is given where the lever does not move without applying further greater control force.

Further, when the control levers 22*d*, 22*e* and 22*f* are manipulated, the output signal proportionally changes from stroke 0% to stroke 110% of the kickdown range. The controller 23 (as part of the first, second and third detecting means) recognizes that the control levers 22*d*, 22*e* and 22*f* have reached to the kickdown range when the output signal received from the control levers 22*d*, 22*e* and 22*f* exceeds a predetermined value (SL).

The same effects and advantages as the first embodiment can be expected in the second embodiment.

Third Embodiment

Figure 11:
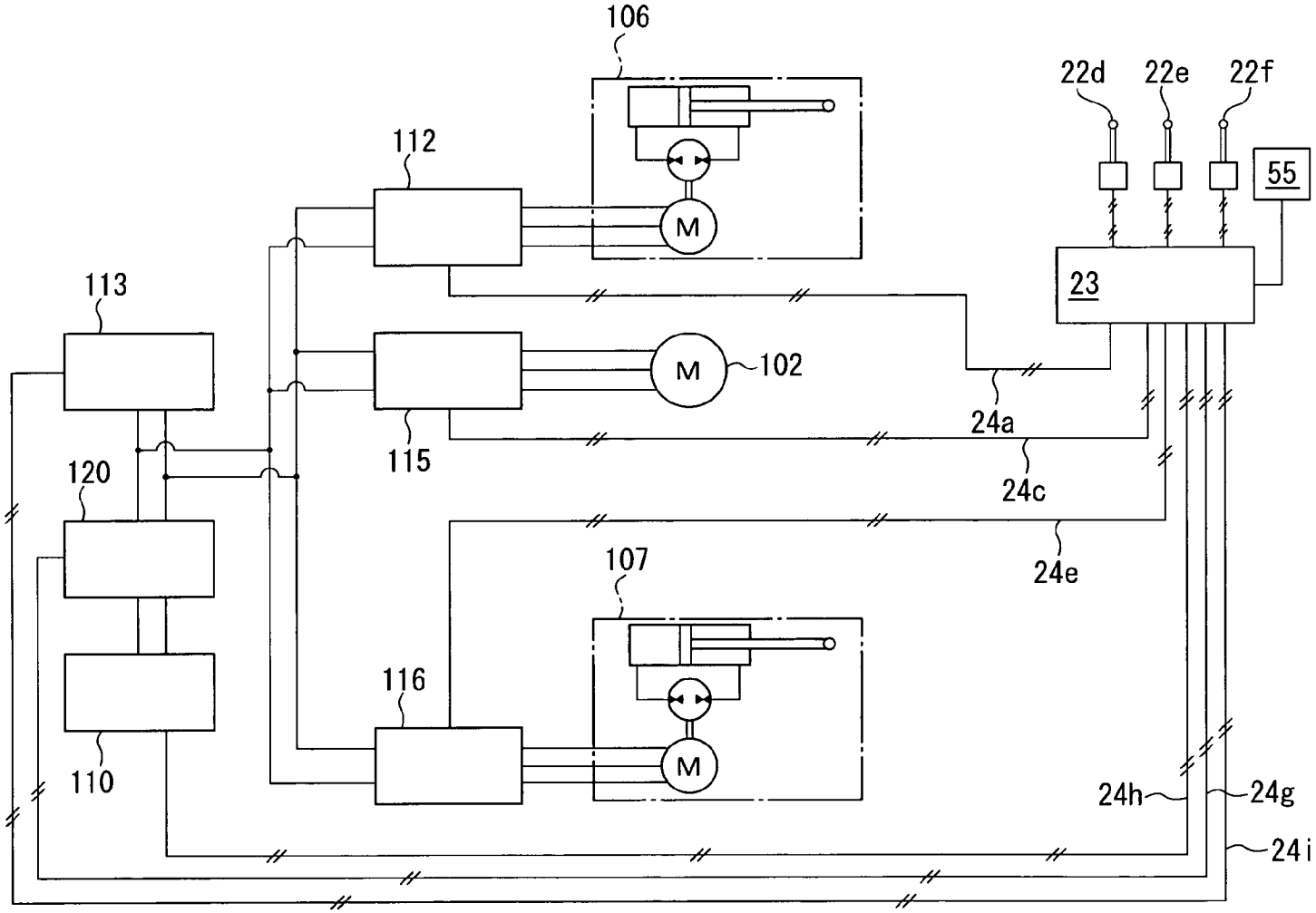
FIG. 11 is a diagram showing a control system circuit according to a third embodiment of the invention.

FIG. 11 shows a control system circuit of an electric excavator according to third embodiment of the invention. The control system circuit of the present embodiment differs from the hydraulic control circuit of the first embodiment in the following.

In the second embodiment, instead of the swing actuator (swing hydraulic motor 2), the pressure compensated flow-control valve 15 of the swing hydraulic motor 2, the boom actuator (boom cylinder 6), the pressure compensated flow-control valve 12 of the boom cylinder 6, the arm actuator (arm cylinder 7) and the pressure compensated flow-control valve 16 of the arm cylinder 7, a swing actuator (swing electric motor 102), an inverter 115 of the swing electric motor 102, a boom actuator (boom cylinder device 106), an inverter 112 of the boom cylinder device 106, an arm actuator (arm cylinder device 107) and an inverter 116 of the arm cylinder device 107 are provided. A battery 110 and a capacitor (electrical condenser) 113 that is charged by the battery 110 are connected to the inverters 115, 112 and 116 via a power controller 120.

In this connection, a control signal from the controller 23 is transmitted to the respective inverters 115, 112 and 116, the power controller 120, the battery 110 and the capacitor 113 via the signal circuits 24*a*, 24*c*, 24*e*, 24*g*, 24*h* and 24*i*.

When the electric control levers 22*d*, 22*e* and 22*f* are constructed by the same levers as those used in the second embodiment, the same effects and advantages as the first embodiment are expected in the third embodiment.

Further, since the total output is controlled by the command from the controller 23 to the inverters 12, 15 and 16 and the power controller 120, the output (110%) when the power-up mode is set on is also increased by the command from the controller 23 to the inverters 12, 15 and 16 and the power controller 120.

It should be readily understood that the present embodiment is applicable to a combination of hydraulic actuator and electric actuator (so-called hybrid excavator).

Incidentally, the scope of the present invention is not limited to the above-described embodiment, but includes modifications and improvements as long as an object of the present invention can be achieved.

For instance, though the operation feeling (notifying unit) provided to the control lever is designed so that, when the control lever reaches to the kickdown range, control force greater than previous control force is required for moving the control lever, other arrangement is possible. On the contrary, the control lever may be designed so that, when the control lever reaches to the kickdown range, the control lever can be moved with a force smaller than the previous force. Alternatively, a notifying unit 80 as shown in FIG. 12 may be used.

Figure 12:
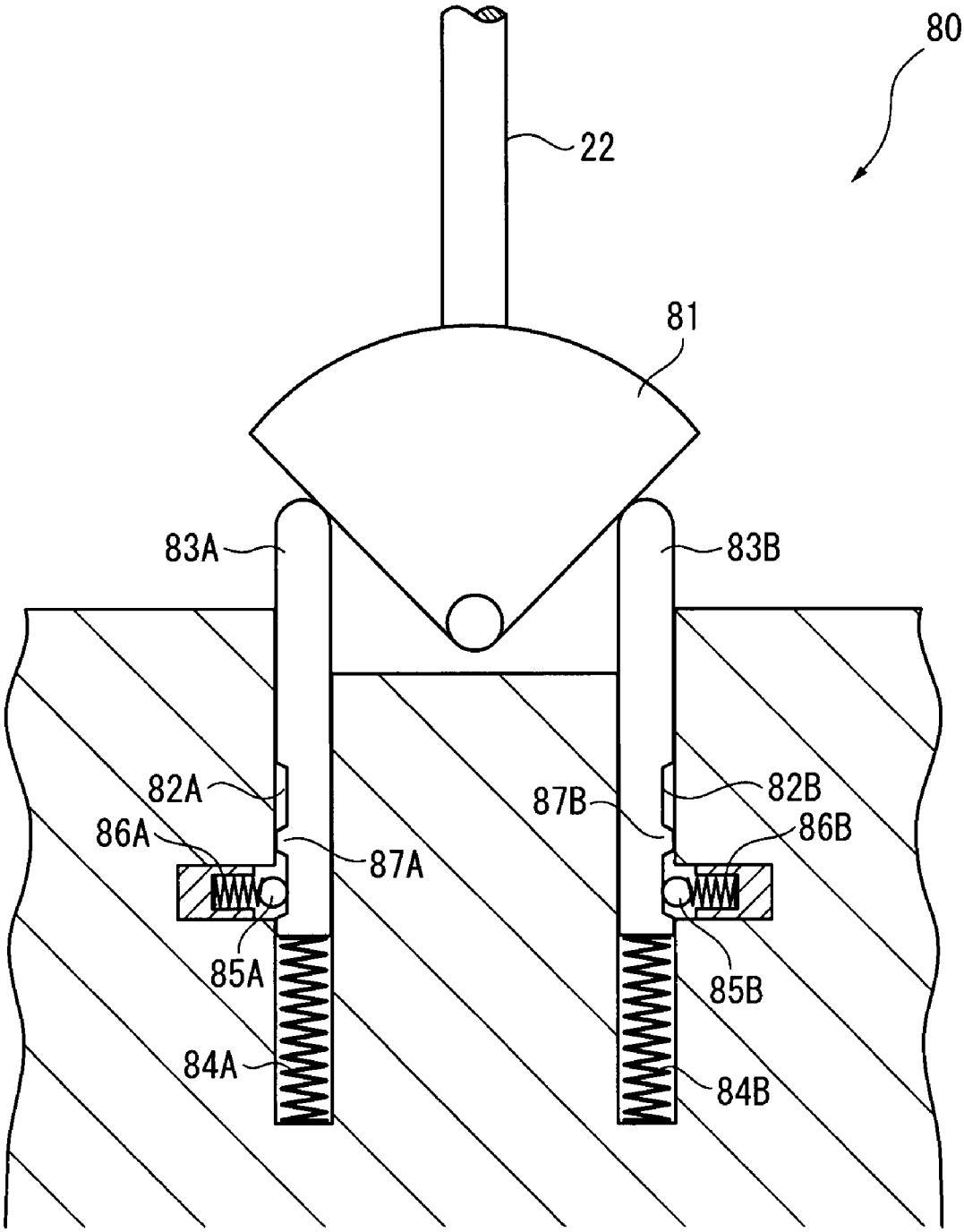
FIG. 12 is an illustration showing a modification of a control lever of the invention.
Figure 13A:
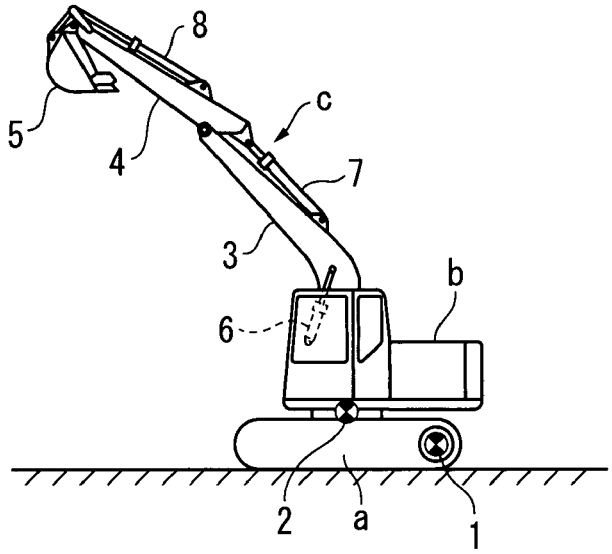
FIG. 13A is an illustration for showing swing movement of an excavator.
Figure 13B:
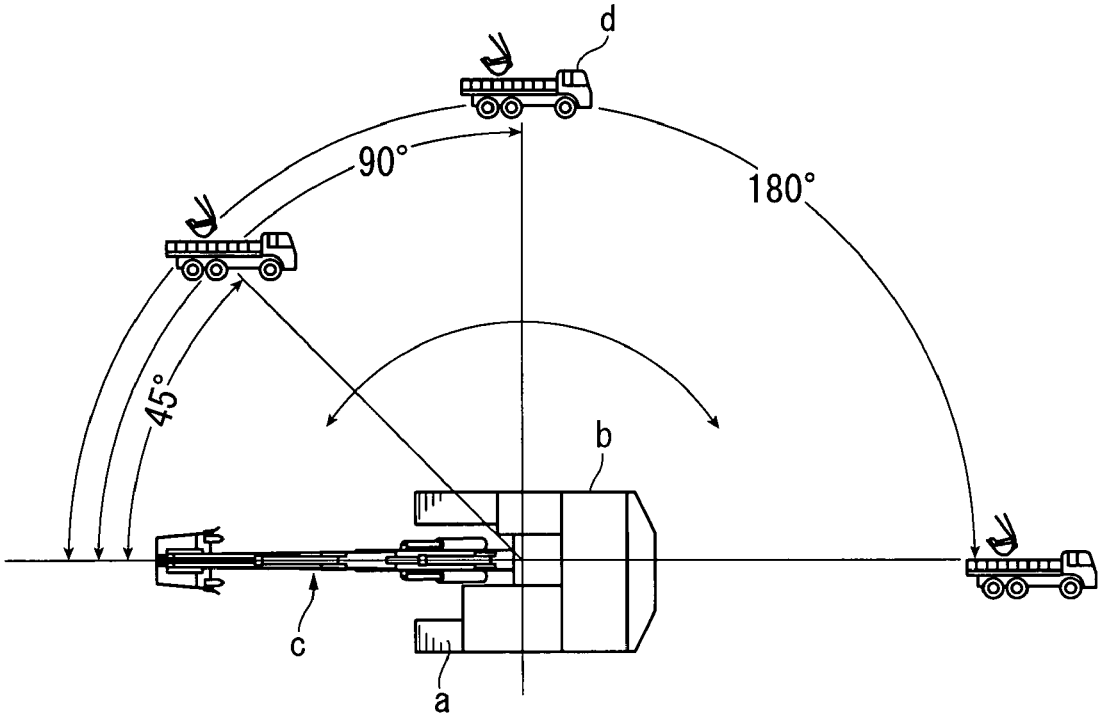
FIG. 13B is another illustration for showing the swing movement of the excavator.

The notifying unit 80 shown in FIG. 12 includes: a sector-shaped rotary plate 81 provided at a rotation support point of the control lever 22; two slide bars 83A and 83B that are in contact with oblique sides of the rotary plate 81 and are advanced and retracted in accordance with the rotation of the rotary plate 81, the slide bars including notched grooves 82A and 82B arranged in the axial direction sandwiching intermediary projections 87A and 87B; springs 84A and 84B that biases the slide bars 83A and 83B so that the respective ends of the slide bars 83A and 83B touch the oblique sides of the rotary plate 81; balls 85A and 85B slidably provided on the sides of the slide bars 83A and 83B; and springs 86A and 86B that press and bias the balls 85A and 85B in a direction to touch the sides of the slide bars 83A and 83B.

According to the above arrangement, the rotary plate 81 is rotated in accordance with the rotation of the control lever 22. Then, either one of the slide bars 83A and 83B are slid downward (in the figure) in accordance with the rotary direction. When one of the projections 87A and 87B of either one of the slide bars 83A and 83B reaches to the position of the balls 85A and 85B, the projection 87A or 87B pushes the balls 85A or 85B against the springs 86A or 86B, so that the force for downwardly (in the figure) sliding the slide bars 83A and 83B is momentarily changed. Accordingly, an operator who manipulates the control lever 22 feels the change in the control force of the control lever 22 and can recognize that the control lever has reached to the kickdown range.

Further, the movement of the control lever may not be felt by the control force but by visual sense, auditory sense, touch and the like. Specifically, arrival of the control lever to the kickdown range may be notified on a display device using a character or a picture, by sound from a speaker, or vibration of the control lever.

Further, the detecting means for detecting the arrival of the control lever to the proximity of the control range may not be a limit switch as in the above embodiments, but other arrangement is possible. For instance, an electric contact point that is electrically in contact with the control lever may be provided adjacent to the control range of the control lever and the arrival is detected when the electric contact point touches the control lever. Alternatively, an optical sensor is provided adjacent to the control range of the control lever and the arrival may be detected when the control lever blocks the optical sensor.

The invention claimed is:

1. A control-mode switching device of an excavator, comprising:

a swing actuator that drives an upper swing body of the excavator;

a boom actuator that drives a boom of the excavator;

an arm actuator that drives an arm of the excavator;

driving means for respectively driving the swing, boom and arm actuators;

a swing control lever that commands movement of the swing actuator in accordance with its operation stroke;

a boom control lever that commands movement of the boom actuator in accordance with its operation stroke;

an arm control lever that commands movement of the arm actuator in accordance with its operation stroke;

first detecting means for detecting arrival of the swing control lever to a proximity of ends of the control range of the swing control lever;

second detecting means for detecting arrival of the boom control lever to a proximity of at least one end of the control range of the boom control lever;

third detecting means for detecting arrival of the arm control lever to a proximity of at least one end of the control range of the arm control lever;

mode judging means for judging whether or not the respective detecting means detect arrival of the respective control levers to the proximity of the ends of the respective control ranges, and for judging whether any one of a plurality of priority operation modes is taken or not based on a combination of judging results of the respective control levers; and drive controlling means for, when it is judged by the mode judging means that any one of the priority operation modes is taken, controlling the driving means so that the output of the selected one or more of the driving means becomes larger than that in the normal mode or the power ratio of the selected one or more of the driving means as compared to other driving means becomes larger.

2. The control-mode switching device of an excavator according to claim 1, the mode judging means comprising:

storing means for storing the plurality of priority operation modes corresponding to the combination of the judging results of the respective control levers; and selecting means for selecting the priority operation mode corresponding to the combination of the judging results of the respective control levers from the storing means.

3. The control-mode switching device of an excavator according to claim 1, wherein:

the actuator includes a hydraulic actuator, the driving means includes a hydraulic circuit and flow-rate controlling means for controlling a flow rate of the hydraulic circuit, and when it is judged by the mode judging means that any one of the priority operation modes is taken, the drive controlling means controls the flow-rate controlling means so that pressure oil supply that is supplied to selected one or more of the hydraulic circuits becomes larger than pressure oil supply that is supplied to the other hydraulic circuit.

4. The control-mode switching device of an excavator according to claim 1, further comprising an engine that drives the plurality of driving means, wherein the drive controlling means increases or decreases power of the engine.

5. The control-mode switching device of an excavator according to claim 1, further comprising a battery that drives the plurality of driving means, wherein the drive controlling means increases or decreases power of the battery.

6. The control-mode switching device of an excavator according to claim 1, wherein:

the actuator includes a hydraulic actuator, the driving means includes a hydraulic circuit and a variable pressure-control valve that varies pressure in the hydraulic circuit, and when it is judged by the mode judging means that any one of the priority operation modes is taken, the drive controlling means controls the variable pressure-control valve so that the pressure in selected one or more of the hydraulic circuits increases.

7. The control-mode switching device of an excavator according to claim 1, further comprising notifying means for notifying an operator of an arrival of one of the control levers to the proximity of the control range thereof.

8. The control-mode switching device of an excavator according to claim 1, wherein at least one of the control levers has a predetermined stroke range which is only a portion of the control range, and a respective one of the detecting means is operable to detect only arrival of the control lever outside of the predetermined stroke range.

9. The control-mode switching device of an excavator according to claim 1, wherein at least one of the detecting means is turned on only when a respective one of the control levers arrives at the proximity of the at least one end of its control range.

10. An excavator, comprising:

a control-mode switching device, the control-mode switching device including:

a swing actuator that drives an upper swing body of the excavator;

a boom actuator that drives a boom of the excavator;

an arm actuator that drives an arm of the excavator;

driving means for respectively driving the swing, boom and arm actuators;

a swing control lever that commands movement of the swing actuator in accordance with its operation stroke;

a boom control lever that commands movement of the boom actuator in accordance with its operation stroke;

an arm control lever that commands movement of the arm actuator in accordance with its operation stroke;

first detecting means for detecting arrival of the swing control lever to a proximity of ends of the control range of the swing control lever;

second detecting means for detecting arrival of the boom control lever to a proximity of at least one end of the control range of the boom control lever;

third detecting means for detecting arrival of the arm control lever to a proximity of at least one end of the control range of the arm control lever;

mode judging means for judging whether or not the respective detecting means detect arrival of the respective control levers to the proximity of the ends of the respective control ranges, and for judging whether any one of a plurality of priority operation modes is taken or not based on a combination of judging results of the respective control levers; and drive controlling means for, when it is judged by the mode judging means that any one of the priority operation modes is taken, controlling the driving means so that the output of the selected one or more of the driving means becomes larger than that in the normal mode or the power ratio of the selected one or more of the driving means as compared to the other driving means becomes larger.

11. The excavator according to claim 10, wherein at least one of the control levers has a predetermined stroke range which is only a portion of the control range, and a respective one of the detecting means is operable to detect only arrival of the control lever outside of the predetermined stroke range.

12. The excavator according to claim 10, wherein at least one of the detecting means is turned on only when a respective one of the control levers arrives at the proximity of the at least one end of its control range.

* * * * *